US008358948B2

(12) United States Patent
Yamamoto et al.

(10) Patent No.: US 8,358,948 B2
(45) Date of Patent: Jan. 22, 2013

(54) FIXING DEVICE AND IMAGE FORMING APPARATUS INCORPORATING SAME

(75) Inventors: Shin Yamamoto, Osaka (JP); Yoshihiro Fukuhata, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/178,411

(22) Filed: Jul. 7, 2011

(65) Prior Publication Data

US 2012/0020690 A1 Jan. 26, 2012

(30) Foreign Application Priority Data

Jul. 26, 2010 (JP) ..... 2010-167280

(51) Int. Cl.
*G03G 15/20* (2006.01)

(52) U.S. Cl. ..... 399/69

(58) Field of Classification Search ..... 399/69, 399/122, 320, 322, 328, 330, 331, 333, 334
See application file for complete search history.

(56) References Cited

U.S. PATENT DOCUMENTS

| | | | | |
|---|---|---|---|---|
| 5,450,181 | A * | 9/1995 | Tsukida et al. | 399/322 |
| 5,737,679 | A * | 4/1998 | Uehara et al. | 399/329 |
| 7,664,447 | B2 | 2/2010 | Yagi et al. | |
| 7,769,332 | B2 | 8/2010 | Yamamoto et al. | |
| 7,813,686 | B2 | 10/2010 | Yagi et al. | |
| 7,831,186 | B2 | 11/2010 | Obata et al. | |
| 7,881,635 | B2 | 2/2011 | Yamazoe et al. | |
| 7,885,591 | B2 | 2/2011 | Yagi et al. | |
| 7,953,361 | B2 | 5/2011 | Obata et al. | |
| 7,970,325 | B2 | 6/2011 | Suzuki et al. | |
| 8,073,371 | B2 | 12/2011 | Yamamoto | |
| 2007/0140752 | A1 | 6/2007 | Yamamoto et al. | |
| 2008/0013992 | A1 | 1/2008 | Fukuhata et al. | |
| 2009/0110418 | A1 | 4/2009 | Ogiso et al. | |
| 2009/0290893 | A1 | 11/2009 | Ogiso et al. | |
| 2010/0054785 | A1 | 3/2010 | Ogiso et al. | |
| 2010/0178089 | A1 | 7/2010 | Fukuhata | |
| 2010/0239297 | A1 | 9/2010 | Sakaya et al. | |

(Continued)

FOREIGN PATENT DOCUMENTS

| | | | |
|---|---|---|---|
| JP | H07-129014 | A | 5/1995 |
| JP | H07-104636 | B2 | 11/1995 |

(Continued)

OTHER PUBLICATIONS

Machine translation of reference Goto et al. (JP 07-129,014 A), Listed in IDS. Pub date May 19, 1995.*

(Continued)

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

A fixing device includes a fixing rotary body and a pressing member each of which includes a waveform elastic layer having at least one wave crest and at least one wave trough to form a waveform face between the fixing rotary body and the pressing member pressed against each other. A controller identifies a temperature differential between a first temperature of the wave crest of the fixing rotary body detected by a first temperature detector and a second temperature of the wave trough of the fixing rotary body detected by a second temperature detector and adjusts an amount of heat stored from a heater into the fixing rotary body based on the identified temperature differential.

16 Claims, 13 Drawing Sheets

U.S. PATENT DOCUMENTS

| | | | | |
|---|---|---|---|---|
| 2010/0260524 | A1 | 10/2010 | Hiraoka et al. | |
| 2010/0272481 | A1 | 10/2010 | Yamamoto et al. | |
| 2010/0296848 | A1* | 11/2010 | Yamamoto et al. | 399/328 |
| 2011/0052285 | A1 | 3/2011 | Fukuhata | |

FOREIGN PATENT DOCUMENTS

| | | | |
|---|---|---|---|
| JP | 3119405 | B2 | 12/2000 |
| JP | 2001-265146 | A | 9/2001 |
| JP | 3267416 | B2 | 3/2002 |
| JP | 2004-109697 | A | 4/2004 |
| JP | 2005-352297 | A | 12/2005 |

OTHER PUBLICATIONS

Machine translation of reference Hayamizu et al. (JP 2005-352,297 A), Listed in IDS. Pub date Dec. 22, 2005.*

Patent Abstracts of Japan, English language Abstract for JP-2001-265146, Sep. 28, 2001, 1 page, Japan Patent Office.

Patent Abstracts of Japan, English language Abstract for JP-2004-109697, Apr. 8, 2004, 1 page, Japan Patent Office.

Patent Abstracts of Japan, English language Abstract for JP-H07-129014, May 19, 1995, 1 page, Japan Patent Office.

Patent Abstracts of Japan, English language Abstract for JP-H06-324588 (corresponds to patent JP-3119405), Nov. 25, 1994, 1 page, Japan Patent Office.

Patent Abstracts of Japan, English language Abstract for JP-H07-121043 (corresponds to patent JP-3267416), May 12, 1995, 1 page, Japan Patent Office.

Patent Abstracts of Japan, English language Abstract for JP-2005-352297, Dec. 22, 2005, 1 page, Japan Patent Office.

Patent Abstracts of Japan, English language Abstract for JP-H02-262684 (corresponds to patent JP-H07-104636), Oct. 25, 1990, 1 page, Japan Patent Office.

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-167280, filed on Jul. 26, 2010, in the Japanese Patent Office, the entire disclosure of which is hereby incorporated herein by reference.

FIELD OF THE INVENTION

Exemplary aspects of the present invention relate to a fixing device and an image forming apparatus, and more particularly, to a fixing device for fixing a toner image on a recording medium, and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing roller inside which a heater is provided and a pressing roller pressed against the fixing roller to form a fixing nip therebetween. As a recording medium bearing a toner image passes through the fixing nip, the fixing roller heated by the heater and the pressing roller apply heat and pressure to the recording medium to fix the toner image on the recording medium.

For example, FIG. 1 is a vertical sectional view of a fixing device 27R having such configuration. As illustrated in FIG. 1, a pressing roller 200 is pressed against a fixing roller 100 to form a fixing nip N therebetween. As a recording medium P bearing a toner image T passes through the fixing nip N, the fixing roller 100 heated by a heater 300 and the pressing roller 200 apply heat and pressure to the recording medium P bearing the toner image T, thus fixing the toner image T on the recording medium P.

After passing through the fixing nip N, the recording medium P bearing the fixed toner image T should be conveyed in a conveyance direction Da. However, since toner of the toner image T is melted by the heated fixing roller 100 at the fixing nip N, it may adhere to the fixing roller 100, deviating the conveyance direction of the recording medium P from the conveyance direction Da toward the fixing roller 100. For example, the conveyance direction of the recording medium P may be angled leftward beyond a border b, and thus the recording medium P may be wound around the fixing roller 100.

Specifically, where F1 defines an adhering force of the melted toner of the toner image T which makes the recording medium P adherent to the fixing roller 100 and F2 defines a bending force required to wind the recording medium P around the fixing roller 100, that is, a force required to angle the recording medium P by an angle θ from the conveyance direction Da to the border b, when the adhering force F1 is smaller than the bending force F2, winding of the recording medium P around the fixing roller 100 can be prevented.

To make the adhering force F1 smaller than the bending force F2, the toner of the toner image T may contain a release agent, such as wax, that facilitates separation of the toner from the fixing roller 100. Conversely, the fixing roller 100 may be downsized into a fixing roller 100*s* having a smaller diameter to change the border defining the limit that prevents winding of the recording medium P around the fixing roller 100 from the border b to a border b', thus increasing the bending force F2 required to wind the recording medium P around the fixing roller 100.

However, even with the above methods of decreasing the adhering force F1 of the toner of the toner image T and downsizing the fixing roller 100 to increase the bending force F2, when a recording sheet of reduced rigidity, such as a thin sheet, is used as a recording medium P, such recording sheet may decrease the bending force F2 required to wind itself around the fixing roller 100. As a result, the non-rigid recording sheet may be wound around the fixing roller 100.

BRIEF SUMMARY OF THE INVENTION

This specification describes below an improved fixing device. In one exemplary embodiment of the present invention, the fixing device fixes a toner image on a recording medium and includes a fixing rotary body heated by a heater and a pressing member pressed against the fixing rotary body to form a fixing nip therebetween through which the recording medium bearing the toner image passes. Each of the fixing rotary body and the pressing member includes a core and a waveform elastic layer provided on the core and having at least one wave crest and at least one wave trough to form a waveform face between the fixing rotary body and the pressing member where the wave trough of the pressing member is pressed against the wave crest of the fixing rotary body and the wave crest of the pressing member is pressed against the wave trough of the fixing rotary body. A first temperature detector is disposed opposite the wave crest of the fixing rotary body to detect a first temperature thereof. A second temperature detector is disposed opposite the wave trough of the fixing rotary body to detect a second temperature thereof. A controller is connected to the heater, the first temperature detector, and the second temperature detector to identify a temperature differential between the first temperature and the second temperature and adjust an amount of heat stored from the heater into the fixing rotary body based on the identified temperature differential.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
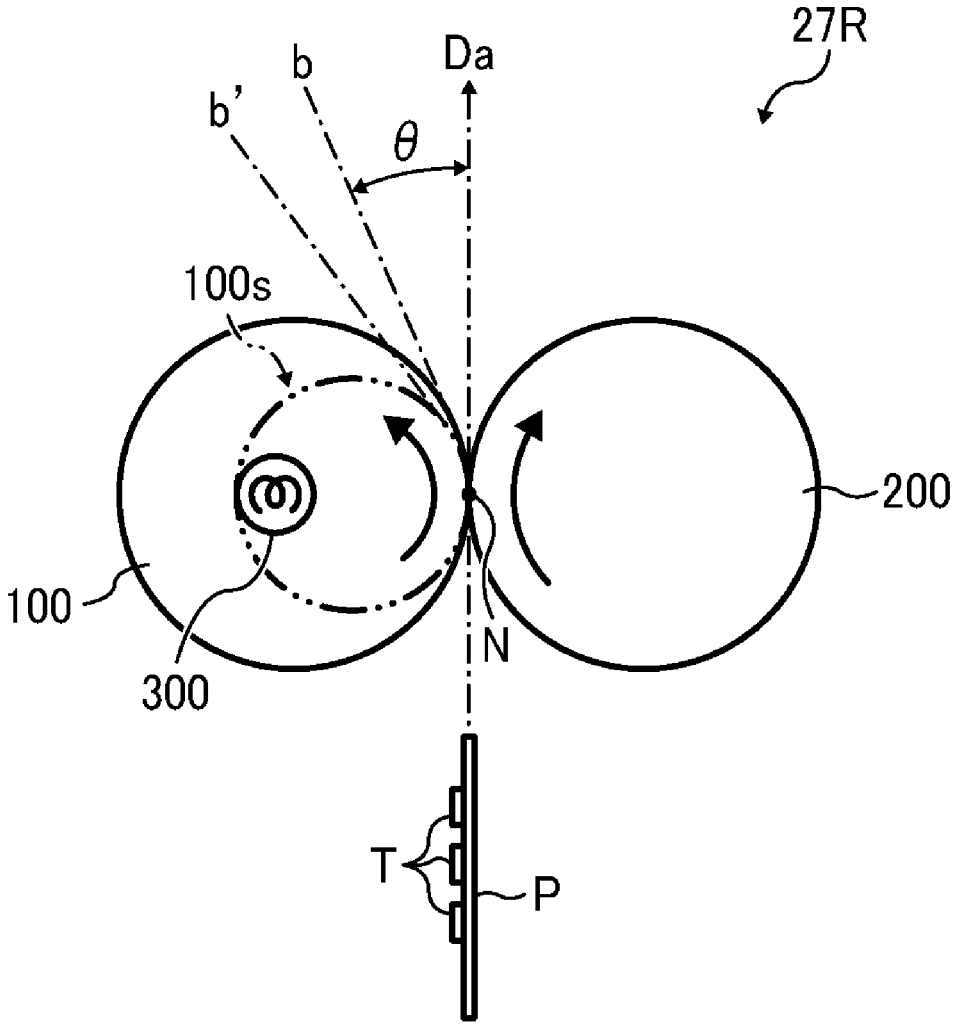
FIG. 1 RELATED ART
FIG. 1 is a vertical sectional view of a related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 2:
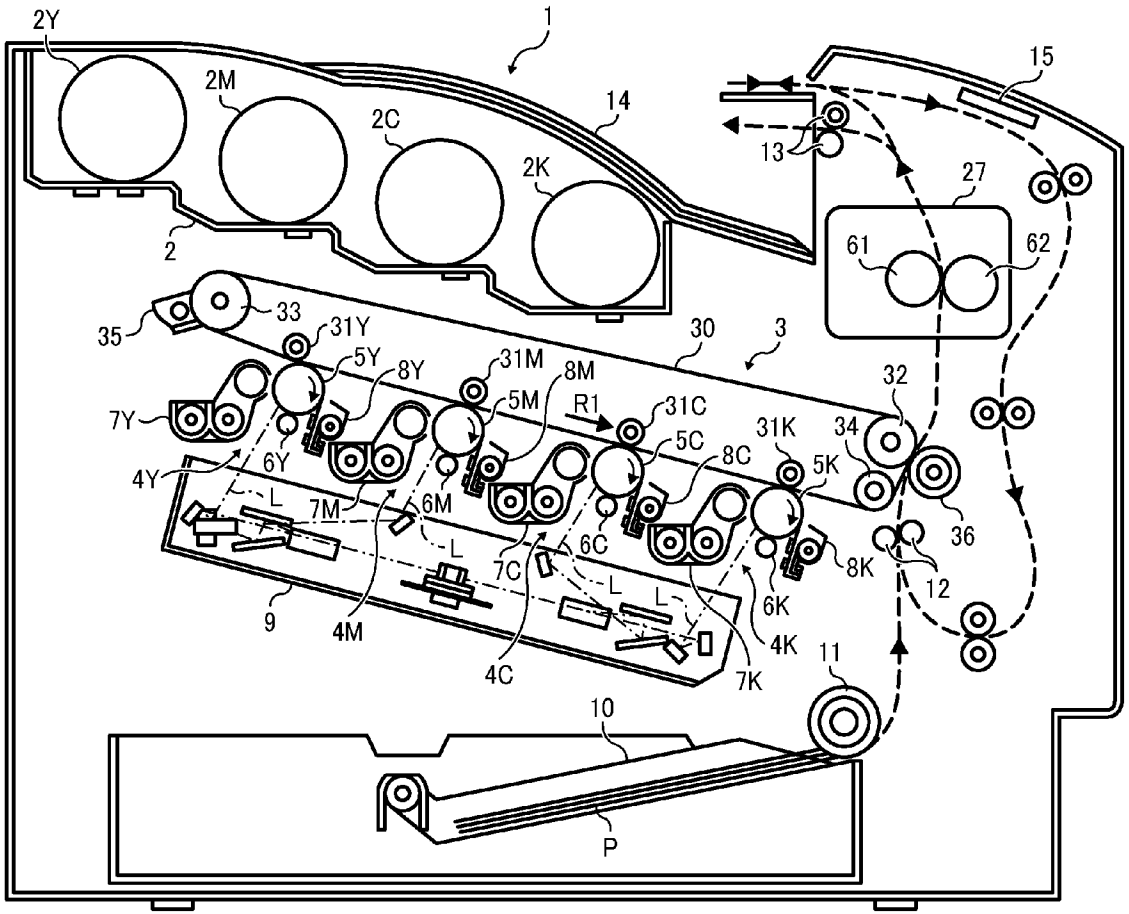
FIG. 2 is a schematic view of an image forming apparatus according to an exemplary embodiment of the present invention.

Referring now to the drawings, wherein like reference numerals designate identical or corresponding parts throughout the several views, in particular to FIG. 2, an image forming apparatus 1 according to an exemplary embodiment of the present invention is explained.

FIG. 2 is a schematic view of the image forming apparatus 1. As illustrated in FIG. 2, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 2, the image forming apparatus 1 includes image forming devices 4Y, 4M, 4C, and 4K disposed in a center portion of the image forming apparatus 1; a toner bottle holder 2 disposed above the image forming devices 4Y, 4M, 4C, and 4K in an upper portion of the image forming apparatus 1; an exposure device 9 disposed below the image forming devices 4Y, 4M, 4C, and 4K; a paper tray 10 disposed below the exposure device 9 in a lower portion of the image forming apparatus 1; an intermediate transfer unit 3 disposed above the image forming devices 4Y, 4M, 4C, and 4K and below the toner bottle holder 2; a second transfer roller 36 disposed opposite the intermediate transfer unit 3; a feed roller 11 and a registration roller pair 12 disposed between the paper tray 10 and the second transfer roller 36 in a conveyance direction of a recording medium P; a fixing device 27 disposed above the second transfer roller 36; an output roller pair 13 disposed above the fixing device 27; an output tray 14 disposed downstream from the output roller pair 13 in the conveyance direction of the recording medium P on top of the image forming apparatus 1; and a controller 15 disposed in the upper portion of the image forming apparatus 1.

The toner bottle holder 2 includes four toner bottles 2Y, 2M, 2C, and 2K that contain yellow, magenta, cyan, and black toners, respectively. They are detachably attached to the toner bottle holder 2, thus replaceable with new ones, respectively.

The intermediate transfer unit 3, disposed below the toner bottle holder 2, includes an intermediate transfer belt 30 formed into a loop, four first transfer bias rollers 31Y, 31M, 31C, and 31K, a second transfer backup roller 32, a cleaning backup roller 33, and a tension roller 34 disposed inside the loop formed by the intermediate transfer belt 30, and an intermediate transfer cleaner 35 disposed outside the loop formed by the intermediate transfer belt 30. Specifically, the intermediate transfer belt 30 is supported by and stretched over three rollers, which are the second transfer backup roller 32, the cleaning backup roller 33, and the tension roller 34. A single roller, that is, the second transfer backup roller 32, drives and endlessly moves (e.g., rotates) the intermediate transfer belt 30 in a direction R1.

The image forming devices 4Y, 4M, 4C, and 4K, arranged opposite the intermediate transfer belt 30, form yellow, magenta, cyan, and black toner images, respectively. The image forming devices 4Y, 4M, 4C, and 4K include photoconductive drums 5Y, 5M, 5C, and 5K which are surrounded by chargers 6Y, 6M, 6C, and 6K, development devices 7Y, 7M, 7C, and 7K, cleaners 8Y, 8M, 8C, and 8K, and dischargers, respectively. Image forming processes including a charging process, an exposure process, a development process, a primary transfer process, and a cleaning process are performed on the photoconductive drums 5Y, 5M, 5C, and 5K to form yellow, magenta, cyan, and black toner images thereon, respectively, as a driving motor drives and rotates the photoconductive drums 5Y, 5M, 5C, and 5K clockwise in FIG. 2.

Specifically, in the charging process, the chargers 6Y, 6M, 6C, and 6K uniformly charge surfaces of the photoconductive drums 5Y, 5M, 5C, and 5K at charging positions where the chargers 6Y, 6M, 6C, and 6K are disposed opposite the photoconductive drums 5Y, 5M, 5C, and 5K, respectively.

In the exposure process, the exposure device 9 emits laser beams L onto the charged surfaces of the respective photoconductive drums 5Y, 5M, 5C, and 5K according to image data sent from a client computer, for example. In other words, the exposure device 9 scans and exposes the charged surfaces of the photoconductive drums 5Y, 5M, 5C, and 5K at irradiation positions where the exposure device 9 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 7Y, 7M, 7C, and 7K render the electrostatic latent images formed on the surfaces of the photoconductive drums 5Y, 5M, 5C, and 5K visible as yellow, magenta, cyan, and black toner images at development positions where the development devices 7Y, 7M, 7C, and 7K are disposed opposite the photoconductive drums 5Y, 5M, 5C, and 5K, respectively. Thus, the photoconductive drums 5Y, 5M, 5C, and 5K serve as image carriers that carry the electrostatic latent images and the resultant toner images, respectively.

In the primary transfer process, the first transfer bias rollers 31Y, 31M, 31C, and 31K transfer and superimpose the yellow, magenta, cyan, and black toner images formed on the photoconductive drums 5Y, 5M, 5C, and 5K onto the intermediate transfer belt 30 at first transfer positions where the first transfer bias rollers 31Y, 31M, 31C, and 31K are disposed opposite the photoconductive drums 5Y, 5M, 5C, and 5K via the intermediate transfer belt 30, respectively. Thus, a color toner image is formed on the intermediate transfer belt 30. After the transfer of the yellow, magenta, cyan, and black toner images, a slight amount of residual toner, which has not been transferred onto the intermediate transfer belt 30, remains on the photoconductive drums 5Y, 5M, 5C, and 5K.

In the cleaning process, cleaning blades included in the cleaners 8Y, 8M, 8C, and 8K mechanically collect the residual toner from the photoconductive drums 5Y, 5M, 5C, and 5K at cleaning positions where the cleaners 8Y, 8M, 8C, and 8K are disposed opposite the photoconductive drums 5Y, 5M, 5C, and 5K, respectively.

Finally, dischargers remove residual potential on the photoconductive drums 5Y, 5M, 5C, and 5K at discharging positions where the dischargers are disposed opposite the photoconductive drums 5Y, 5M, 5C, and 5K, respectively, thus completing a single sequence of image forming processes performed on the photoconductive drums 5Y, 5M, 5C, and 5K.

The following describes the transfer processes, that is, the primary transfer process described above and a secondary transfer process, performed on the intermediate transfer belt 30. The four first transfer bias rollers 31Y, 31M, 31C, and 31K and the photoconductive drums 5Y, 5M, 5C, and 5K sandwich the intermediate transfer belt 30 to form first transfer nips, respectively. The first transfer bias rollers 31Y, 31M, 31C, and 31K are applied with a transfer bias having a polarity opposite a polarity of toner forming the yellow, magenta, cyan, and black toner images on the photoconductive drums 5Y, 5M, 5C, and 5K, respectively. Accordingly, in the primary transfer process, the yellow, magenta, cyan, and black toner images formed on the photoconductive drums 5Y, 5M, 5C, and 5K, respectively, are primarily transferred and superimposed onto the intermediate transfer belt 30 rotating in the direction R1 successively at the first transfer nips formed between the photoconductive drums 5Y, 5M, 5C, and 5K and the intermediate transfer belt 30 as the intermediate transfer belt 30 moves through the first transfer nips. Thus, a color toner image is formed on the intermediate transfer belt 30.

The second transfer roller 36 is pressed against the second transfer backup roller 32 via the intermediate transfer belt 30 in such a manner that the second transfer roller 36 and the second transfer backup roller 32 sandwich the intermediate transfer belt 30 to form a second transfer nip between the second transfer roller 36 and the intermediate transfer belt 30. At the second transfer nip, the second transfer roller 36 secondarily transfers the color toner image formed on the intermediate transfer belt 30 onto a recording medium P sent from the paper tray 10 through the feed roller 11 and the registration roller pair 12 in the secondary transfer process. Thus, the desired color toner image is formed on the recording medium P. After the transfer of the color toner image, residual toner, which has not been transferred onto the recording medium P, remains on the intermediate transfer belt 30.

Thereafter, the intermediate transfer cleaner 35 collects the residual toner from the intermediate transfer belt 30 at a cleaning position where the intermediate transfer cleaner 35 is disposed opposite the cleaning backup roller 33 via the intermediate transfer belt 30, thus completing a single sequence of transfer processes performed on the intermediate transfer belt 30.

The recording medium P is supplied to the second transfer nip from the paper tray 10 which loads a plurality of recording media P (e.g., recording sheets). Specifically, the feed roller 11 rotates counterclockwise in FIG. 2 to feed an uppermost recording medium P of the plurality of recording media P loaded on the paper tray 10 toward a roller nip formed between two rollers of the registration roller pair 12.

The registration roller pair 12, which stops rotating temporarily, stops the uppermost recording medium P fed by the feed roller 11 and reaching the registration roller pair 12. For example, the roller nip of the registration roller pair 12 contacts and stops a leading edge of the recording medium P. The registration roller pair 12 resumes rotating to feed the recording medium P to the second transfer nip formed between the second transfer roller 36 and the intermediate transfer belt 30, as the color toner image formed on the intermediate transfer belt 30 reaches the second transfer nip.

After the secondary transfer process described above, the recording medium P bearing the color toner image is sent to the fixing device 27 that includes a fixing roller 61 and a pressing roller 62. As the recording medium P bearing the color toner image passes between the fixing roller 61 and the pressing roller 62, they apply heat and pressure to the recording medium P to fix the color toner image on the recording medium P.

Thereafter, the fixing device 27 feeds the recording medium P bearing the fixed color toner image toward the output roller pair 13. The output roller pair 13 discharges the recording medium P to an outside of the image forming apparatus 1, that is, the output tray 14. Thus, the recording media P discharged by the output roller pair 13 are stacked on the output tray 14 successively to complete a single sequence of image forming processes performed by the image forming apparatus 1.

Figure 3:
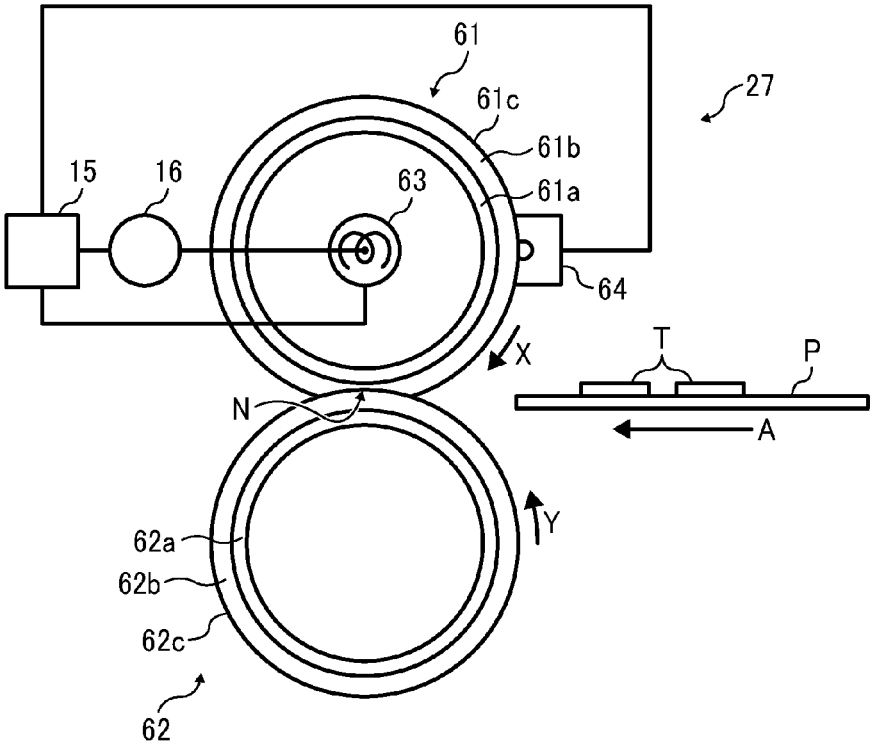
FIG. 3 is a vertical sectional view of a fixing device included in the image forming apparatus shown in FIG. 2.

Referring to FIG. 3, the following describes the structure of the fixing device 27 installed in the image forming apparatus 1 described above.

FIG. 3 is a vertical sectional view of the fixing device 27. As illustrated in FIG. 3, the fixing device 27 includes the fixing roller 61 serving as a fixing member or a fixing rotary body that is rotated by a driver 16 (e.g., a motor) clockwise in FIG. 3 in a rotation direction X; the pressing roller 62 serving as a pressing member that is rotated in a rotation direction Y counter to the rotation direction X of the fixing roller 61 in accordance with rotation thereof; and a heater lamp 63 disposed inside the fixing roller 61 to heat it. The pressing roller 62 is pressed against the fixing roller 61 to form a fixing nip N therebetween; thus the fixing roller 61 and the pressing roller 62 serve as a pair of nip formation members that forms the fixing nip N through which a recording medium P bearing a toner image T passes. As the recording medium P conveyed in a direction A passes through the fixing nip N, the fixing roller 61 heated by the heater lamp 63 and the pressing roller 62 apply heat and pressure to the recording medium P to fix the toner image T on the recording medium P.

For example, the fixing roller 61 is constructed of a tubular metal core 61*a*; an elastic layer 61*b* covering an outer circumferential surface of the core 61*a*; and a release layer 61*c* covering an outer circumferential surface of the elastic layer 61*b*. Similarly, the pressing roller 62 is constructed of a tubular metal core 62*a*; an elastic layer 62*b* covering an outer circumferential surface of the core 62*a*; and a release layer 62*c* covering an outer circumferential surface of the elastic layer 62*b*. The cores 61*a* and 62*a* are made of metal such as iron and/or aluminum; the elastic layers 61*b* and 62*b* are made of silicon rubber having a thickness in a range of from about 0.3 mm to about 2.5 mm. The release layers 61*c* and 62*c* are a tube made of tetrafluoroethylene-perfluoroalkylvinylether copolymer (PFA) having a thickness not greater than about 50 μm. Between the core 61*a* and the elastic layer 61*b* of the fixing roller 61 is a lubricant or a lubricating layer made of the lubricant having an upper temperature limit of about 250 degrees centigrade and a thickness of about 50 μm, which adheres the elastic layer 61*b* to the core 61*a*. Similarly, such lubricant or lubricating layer is provided between the core 62*a* and the elastic layer 62*b* of the pressing roller 62.

The pressing roller 62 is pressed against the fixing roller 61 by a biasing member (e.g., a spring), not shown, to form the fixing nip N therebetween. The fixing nip N has a length of, for example, about 6 mm in the conveyance direction of the recording medium P, that is, the direction A. Inside the fixing roller 61 is the heater lamp 63, serving as a heater or a heat source that heats the fixing roller 61, extending in an axial direction of the fixing roller 61.

The fixing device 27 further includes a temperature detector 64, disposed opposite the fixing roller 61, which detects a temperature of an outer circumferential surface of the fixing roller 61. The controller 15, that is, a central processing unit (CPU) provided with a random-access memory (RAM) and a read-only memory (ROM), for example, controls an amount of heat generated by the heater lamp 63 based on the temperature of the fixing roller 61 detected by the temperature detector 64, thus adjusting the temperature of the fixing roller 61 to a predetermined fixing temperature at which the fixing roller 61 fixes the toner image T on the recording medium P.

Referring to FIG. 3, the following describes the operation of the fixing device 27 having the above-described structure.

When the image forming apparatus 1 depicted in FIG. 2 receives a print request from a client computer, for example, the heater lamp 63 of the fixing device 27 heats the fixing roller 61 as the controller 15 controls the amount of heat generated by the heater lamp 63 based on the temperature of the fixing roller 61 detected by the temperature detector 64 to adjust the temperature of the fixing roller 61 to the predetermined fixing temperature. As the recording medium P bearing the toner image T conveyed in the direction A passes through the fixing nip N formed between the fixing roller 61 driven by the driver 16 and the pressing roller 62 driven by the fixing roller 61, the fixing roller 61 and the pressing roller 62 apply heat and pressure to the recording medium P to fix the toner image T on the recording medium P.

Figure 4:
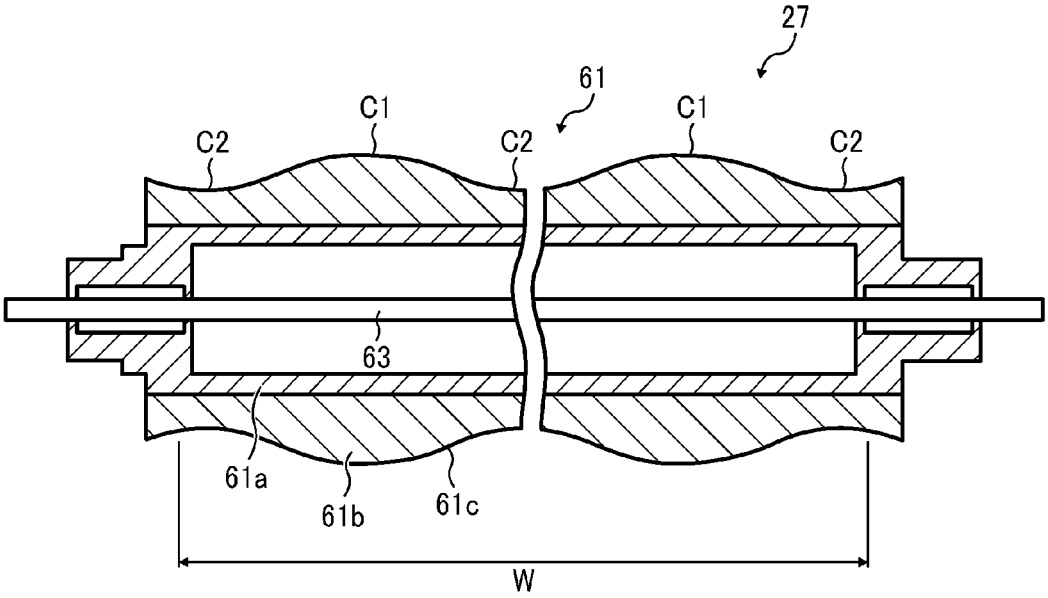
FIG. 4 is a horizontal sectional view of a fixing roller included in the fixing device shown in FIG. 3.

Referring to FIG. 4, the following describes the fixing roller 61 of the fixing device 27 described above. FIG. 4 is a horizontal sectional view of the fixing roller 61.

As illustrated in FIG. 4, the core 61*a* and the release layer 61*c* of the fixing roller 61 have a uniform thickness over the axial direction of the fixing roller 61. By contrast, the elastic layer 61*b* of the fixing roller 61 has a varied thickness in the axial direction of the fixing roller 61, with portions of increased thickness alternating with portions of decreased thickness, giving the outer circumferential surface of the fixing roller 61 an uneven, wavy surface over the axial direction thereof. For example, the elastic layer 61*b* includes a crown portion C1, that is, a convex portion, and an inverted crown portion C2, that is, a concave portion, alternately provided in the axial direction of the fixing roller 61 on the outer circumferential surface thereof. Specifically, the crown portion C1 has a decreased thickness at lateral ends and an increased thickness at a center thereof in the axial direction of the fixing roller 61. In other words, the thickness of the crown portion C1 decreases from the center toward the lateral ends thereof in the axial direction of the fixing roller 61, thus decreasing the diameter of the fixing roller 61. By contrast, the inverted crown portion C2 has an increased thickness at lateral ends and a decreased thickness at a center thereof in the axial direction of the fixing roller 61. In other words, the thickness of the inverted crown portion C2 increases from the center toward the lateral ends thereof in the axial direction of the fixing roller 61, thus increasing the diameter of the fixing roller 61.

Figure 5:
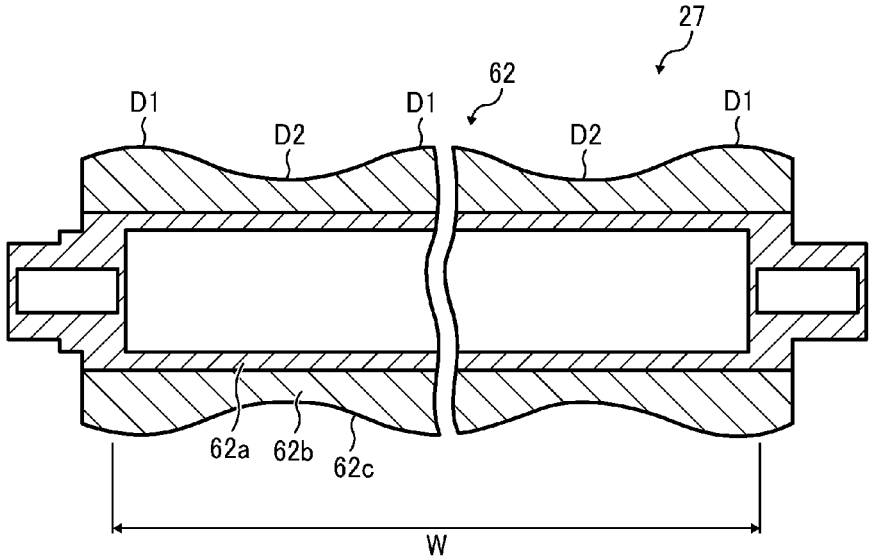
FIG. 5 is a horizontal sectional view of a pressing roller included in the fixing device shown in FIG. 3.

FIG. 5 is a horizontal sectional view of the pressing roller 62.

As illustrated in FIG. 5, similar to the fixing roller 61 depicted in FIG. 4, the core 62*a* and the release layer 62*c* of the pressing roller 62 have a uniform thickness over an axial direction of the pressing roller 62. By contrast, the elastic layer 62*b* of the pressing roller 62 has a varied thickness in the axial direction of the pressing roller 62, with portions of increased thickness alternating with portions of decreased thickness, giving an outer circumferential surface of the pressing roller 62 an uneven, wavy surface over the axial direction thereof. For example, the elastic layer 62*b* includes a crown portion D1, that is, a convex portion, and an inverted crown portion D2, that is, a concave portion, alternately provided in the axial direction of the pressing roller 62 on the outer circumferential surface thereof. Specifically, the crown portion D1 has a decreased thickness at lateral ends and an increased thickness at a center thereof in the axial direction of the pressing roller 62. In other words, the thickness of the crown portion D1 decreases from the center toward the lateral ends thereof in the axial direction of the pressing roller 62, thus decreasing the diameter of the pressing roller 62. By contrast, the inverted crown portion D2 has an increased thickness at lateral ends and a decreased thickness at a center thereof in the axial direction of the pressing roller 62. In other words, the thickness of the inverted crown portion D2 increases from the center toward the lateral ends thereof in the axial direction of the pressing roller 62, thus increasing the diameter of the pressing roller 62.

The crown portions C1 and D1 and the inverted crown portions C2 and D2 are curved, for example, arc-shaped or sine-waved along the axial direction of the fixing roller 61 and the pressing roller 62. Further, according to this exemplary embodiment, the crown portions C1 and D1 and the inverted crown portions C2 and D2 are provided at least over a range of the fixing roller 61 and the pressing roller 62 corresponding to a maximum width W of a maximum recording medium P that the image forming apparatus 1 depicted in FIG. 2 can accommodate. In other words, they are provided at least over a region on the fixing roller 61 and the pressing roller 62 through which the maximum recording medium P passes. Alternatively, they may be provided over a part of the maximum width W of the maximum recording medium P. Yet further alternatively, a straight portion, having a uniform thickness in the axial direction of the fixing roller 61 and the pressing roller 62, may be provided between the crown portion C1 and the adjacent inverted crown portion C2 of the fixing roller 61 and between the crown portion D1 and the adjacent inverted crown portion D2 of the pressing roller 62.

Although FIG. 4 illustrates a plurality of crown portions C1 and a plurality of inverted crown portions C2 of the fixing roller 61 and FIG. 5 illustrates a plurality of crown portions D1 and a plurality of inverted crown portions D2 of the pressing roller 62, the fixing roller 61 may have at least one crown portion C1 and at least one inverted crown portion C2; similarly the pressing roller 62 may have at least one crown portion D1 and at least one inverted crown portion D2.

Figure 6:
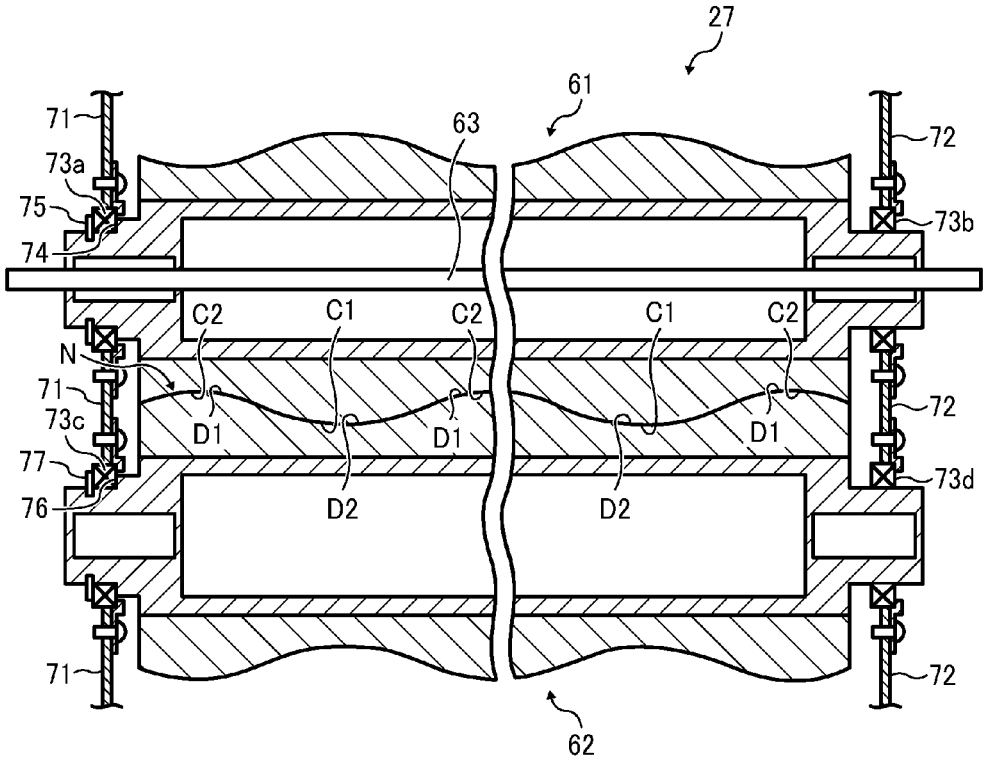
FIG. 6 is a horizontal sectional view of the fixing roller shown in FIG. 4 and the pressing roller shown in FIG. 5 pressed against the fixing roller.

FIG. 6 is a horizontal sectional view of the fixing roller 61 and the pressing roller 62 pressed against the fixing roller 61 by a pressing mechanism.

As illustrated in FIG. 6, when the pressing roller 62 is pressed against the fixing roller 61, the crown portion C1 of the fixing roller 61 contacts the inverted crown portion D2 of the pressing roller 62 and at the same time the inverted crown portion C2 of the fixing roller 61 contacts the crown portion D1 of the pressing roller 62. Thus, the number of the crown portions C1 is equal to the number of the inverted crown portions D2; the number of the crown portions D1 is equal to the number of the inverted crown portions C2.

As illustrated in FIG. 6, the fixing roller 61 and the pressing roller 62 are attached to and supported by two side plates 71 and 72 at lateral ends of the fixing roller 61 and the pressing roller 62 in the axial direction thereof. The side plates 71 and 72, serving as a first support and a second support, respectively, are disposed inside the image forming apparatus 1 depicted in FIG. 2 with a predetermined gap therebetween. According to this exemplary embodiment, the left lateral end of each of the fixing roller 61 and the pressing roller 62 is attached to the left side plate 71 immovably in the axial direction of the fixing roller 61 and the pressing roller 62; the right lateral end of each of the fixing roller 61 and the pressing roller 62 is attached to the right side plate 72 movably in the axial direction of the fixing roller 61 and the pressing roller 62.

For example, the lateral ends of the fixing roller 61 in the axial direction thereof are rotatably supported by bearings 73*a* and 73*b* (e.g., ball bearings) mounted on the side plates 71 and 72, respectively. Similarly, the lateral ends of the pressing roller 62 in the axial direction thereof are rotatably supported by bearings 73*c* and 73*d* (e.g., ball bearings) mounted on the side plates 71 and 72, respectively. The bearing 73*a* disposed at the left lateral end of the fixing roller 61 in the axial direction thereof is sandwiched between a retaining ring 75 and a step 74 disposed on the outer circumferential surface of the fixing roller 61, rendering the left lateral end of the fixing roller 61 immovable with respect to the bearing 73*a* in the axial direction of the fixing roller 61. Conversely, the right lateral end of the fixing roller 61 in the axial direction thereof is movable with respect to the bearing 73*b*, therefore movable in the axial direction of the fixing roller 61.

Similarly, the bearing 73*c* disposed at the left lateral end of the pressing roller 62 in the axial direction thereof is sandwiched between a retaining ring 77 and a step 76 disposed on the outer circumferential surface of the pressing roller 62, rendering the left lateral end of the pressing roller 62 immovable with respect to the bearing 73*c* in the axial direction of the pressing roller 62. Conversely, the right lateral end of the pressing roller 62 in the axial direction thereof is movable with respect to the bearing 73*d*, therefore movable in the axial direction of the pressing roller 62.

As described above, the fixing roller 61 and the pressing roller 62 are immovably mounted on the side plate 71 in the axial direction thereof at the common lateral end, that is, the left lateral end in FIG. 6, in the axial direction thereof; by contrast, another lateral end, that is, the right lateral end in FIG. 6, of the fixing roller 61 and the pressing roller 62 in the axial direction thereof is movable in the axial direction thereof. Accordingly, even when the fixing roller 61 thermally expands in the axial direction thereof, the pressing roller 62 expands in the same direction as the fixing roller 61. According to this exemplary embodiment, the left lateral end of the fixing roller 61 and the pressing roller 62 in FIG. 6 is stationary in the axial direction thereof; the right lateral end of the fixing roller 61 and the pressing roller 62 in FIG. 6 is movable in the axial direction thereof. Alternatively, the right lateral end of the fixing roller 61 and the pressing roller 62 in FIG. 6 may be stationary and the left lateral end of the fixing roller 61 and the pressing roller 62 in FIG. 6 may be movable as long as the common lateral end of the fixing roller 61 and the pressing roller 62 is stationary and another common lateral end of the fixing roller 61 and the pressing roller 62 is movable.

Figure 7:
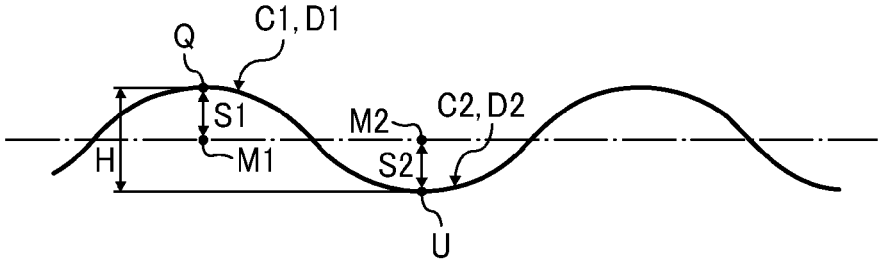
FIG. 7 is an enlarged horizontal sectional view of a crown portion and an inverted crown portion of the fixing roller and the pressing roller shown in FIG. 6.

Referring to FIG. 7, the following describes the crown portions C1 and D1 and the inverted crown portions C2 and D2 of the fixing roller 61 and the pressing roller 62.

FIG. 7 is an enlarged horizontal sectional view of the crown portions C1 and D1 and the inverted crown portions C2 and D2 of the fixing roller 61 and the pressing roller 62.

In FIG. 7, a height S1 defines a height (e.g., a positive amplitude) of the crown portions C1 and D1 from an undisturbed position M1 to a wave crest Q thereof; a depth S2 defines a depth (e.g., a negative amplitude) of the inverted crown portions C2 and D2 from an undisturbed position M2 to a wave trough U thereof; a wave height H defines a height from the wave trough U of the inverted crown portions C2 and D2 to the wave crest Q of the crown portions C1 and D1.

According to this exemplary embodiment, when the pressing roller 62 is pressed against the fixing roller 61 with load applied to the fixing nip N as illustrated in FIG. 6, the wave height H is preferably in a range of from about 0.16 mm to about 0.80 mm at the fixing nip N due to the reasons described below.

When the fixing nip N is applied with load by the pressing roller 62 pressed against the fixing roller 61, the load compresses the elastic layer 61*b* (depicted in FIG. 3) of the fixing roller 61 and the elastic layer 62*b* (depicted in FIG. 3) of the pressing roller 62, making the wave height H smaller compared to when the fixing nip N is not applied with load while the pressing roller 62 is not pressed against the fixing roller 61.

Generally, with the compression rate of the elastic layers 61*b* and 62*b* exceeding 20 percent, the elastic layers 61*b* and 62*b* suffer from plastic deformation, generating noise in the toner image or abnormal noise. To address this problem, the compression rate of the elastic layers 61*b* and 62*b* is generally set to 20 percent or less. According to this exemplary embodiment, the compression rate of the elastic layers 61*b* and 62*b* is set to 20 percent. Thus, the wave height H in a load state in which the fixing nip N is applied with load when the pressing roller 62 is pressed against the fixing roller 61 is 80 percent of the wave height H in a non-load state in which the fixing nip N is not applied with load when the pressing roller 62 is not pressed against the fixing roller 61. Accordingly, the wave height H in the non-load state is set to be greater than the wave height H in the load state. For example, according to this exemplary embodiment in which the compression rate of the elastic layers 61*b* and 62*b* is set to 20 percent, the wave height H in the non-load state, which is greater than the wave height H in the load state in a range of from about 0.16 mm to about 0.80 mm by 1.25 times, is in a range of from about 0.20 mm to about 1.00 mm.

Further, according to this exemplary embodiment, since the height S1, that is, the positive amplitude, of the crown portions C1 and D1 of the fixing roller 61 and the pressing roller 62, respectively, is equivalent to the depth S2, that is, the negative amplitude, of the inverted crown portions C2 and D2 of the fixing roller 61 and the pressing roller 62, respectively, the height S1 and the depth S2 in the non-load state are set to within half of the wave height H in a range of from about 0.20 mm to about 1.00 mm in the non-load state. Accordingly, the height S1 and the depth S2 in the non-load state are set to in a range of from about 0.10 mm to about 0.50 mm.

It is to be noted that the product hardness of the fixing roller 61 and the pressing roller 62 is set not greater than 80 degrees. The "product hardness" defines the surface hardness of the fixing roller 61 and the pressing roller 62 as manufactured products, specifically as a pair of nip formation members that forms the fixing nip N.

On the other hand, in a standby mode in which the fixing device 27 does not perform fixing, if the fixing roller 61 and the pressing roller 62 are pressed against each other at the same nip portions on the fixing roller 61 and the pressing roller 62, respectively, for an extended period of time, the elastic layer 61*b* of the fixing roller 61 and the elastic layer 62*b* of the pressing roller 62 may suffer from plastic deformation. To address this problem, the fixing roller 61 and the pressing roller 62 are rotated by 120 degrees, for example, periodically (e.g., every hour) to vary the nip portions on the fixing roller 61 and the pressing roller 62, respectively, where they are pressed against each other.

Figure 8:
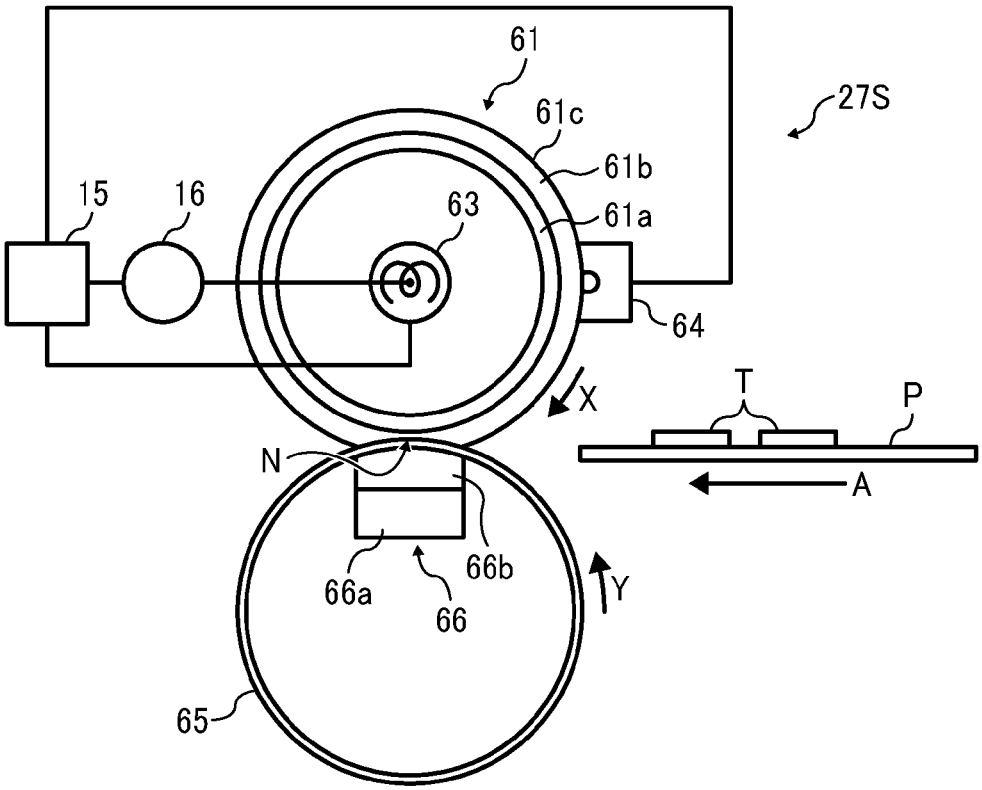
FIG. 8 is a vertical sectional view of a fixing device according to another exemplary embodiment of the present invention.
Figure 9:
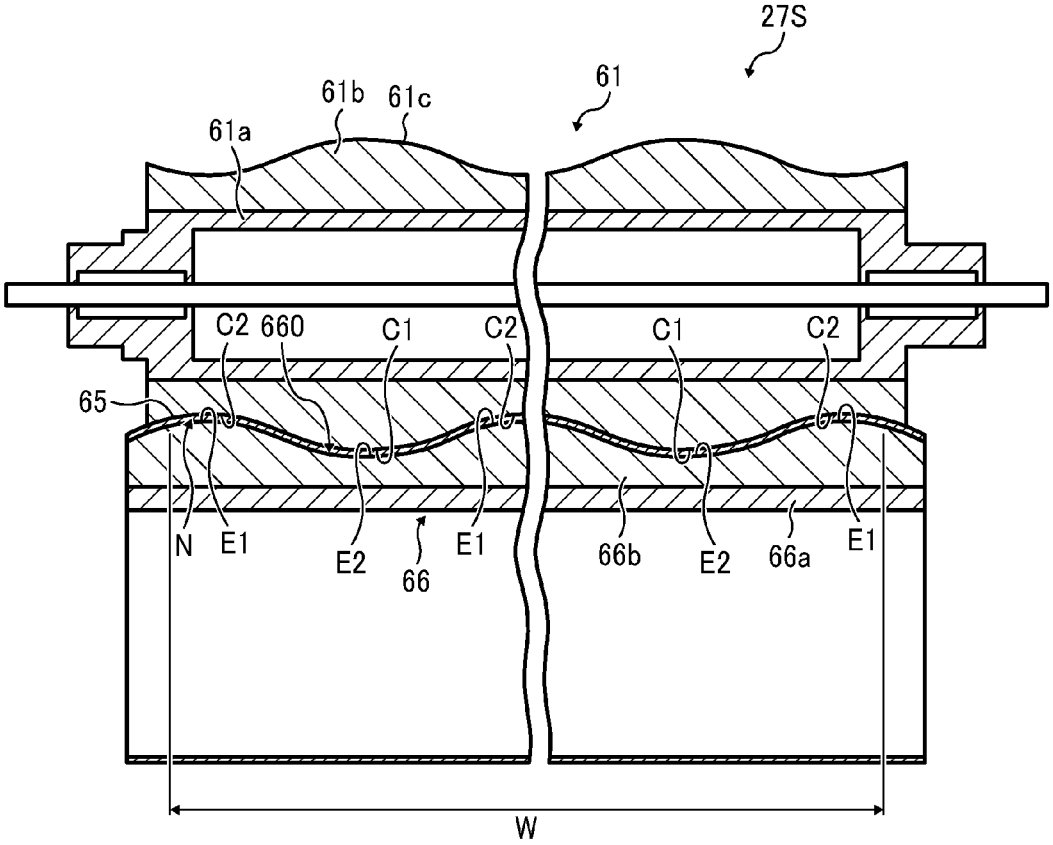
FIG. 9 is a horizontal sectional view of the fixing device shown in FIG. 8.

Referring to FIGS. 8 and 9, the following describes a fixing device 27S according to another exemplary embodiment of the present invention.

FIG. 8 is a vertical sectional view of the fixing device 27S. Referring to FIG. 8, a detailed description is now given of the structure of the fixing device 27S.

As illustrated in FIG. 8, the fixing device 27S includes the fixing roller 61 serving as a fixing member or a fixing rotary body that rotates in the rotation direction X; a pressing belt 65, formed into a loop, that contacts the fixing roller 61 and rotates in the rotation direction Y counter to the rotation direction X of the fixing roller 61; a pressing pad 66, serving as a pressing member, disposed inside the loop formed by the pressing belt 65; the heater lamp 63 disposed inside the fixing roller 61; and a temperature detector 64 disposed opposite the fixing roller 61 to detect the temperature of the outer circumferential surface of the fixing roller 61. The pressing pad 66 presses the pressing belt 65 against the fixing roller 61 to form the fixing nip N between the pressing belt 65 and the fixing roller 61.

The pressing belt 65 is an endless belt made of polyimide film. The pressing pad 66 is constructed of an elastic layer 66*b* made of silicon rubber; and a core 66*a* that supports the elastic layer 66*b*. The pressing pad 66 is biased against the fixing roller 61 by a biasing member while the elastic layer 66*b* of the pressing pad 66 contacts an inner circumferential surface of the pressing belt 65. That is, the pressing pad 66 contacting the inner circumferential surface of the pressing belt 65 is pressed against the fixing roller 61 to form the fixing nip N between the pressing belt 65 and the fixing roller 61.

Similar to the fixing device 27 depicted in FIG. 3, the fixing roller 61 is constructed of the tubular metal core 61*a*; the elastic layer 61*b* covering the outer circumferential surface of the core 61*a*; and the release layer 61*c* covering the outer circumferential surface of the elastic layer 61*b*.

Referring to FIG. 8, a detailed description is now given of the operation of the fixing device 27S.

When the heater lamp 63 is powered on to heat the fixing roller 61, the controller 15 controls the amount of heat generated by the heater lamp 63 based on the temperature of the fixing roller 61 detected by the temperature detector 64, thus adjusting the temperature of the fixing roller 61 to a predetermined fixing temperature. As the recording medium P bearing the toner image T conveyed in the direction A passes through the fixing nip N formed between the fixing roller 61 and the pressing belt 65, the fixing roller 61 and the pressing belt 65 pressed by the fixing pad 66 apply heat and pressure to the recording medium P to fix the toner image T on the recording medium P.

Referring to FIG. 9, the following describes the fixing roller 61 and the pressing belt 65 of the fixing device 27S.

FIG. 9 is a horizontal sectional view of the fixing device 27S. As illustrated in FIG. 9, the fixing roller 61 of the fixing device 27S is equivalent to the fixing roller 61 of the fixing device 27 depicted in FIG. 4. That is, the fixing roller 61 includes at least one crown portion C1 (e.g., the convex portion) and at least one inverted crown portion C2 (e.g., the concave portion). Similar to the elastic layer 61*b* of the fixing roller 61 of the fixing device 27, the elastic layer 61*b* of the fixing roller 61 of the fixing device 27S has a thickness varying in the axial direction thereof to produce the crown portion C1 and the inverted crown portion C2.

The pressing pad 66 includes a pressing face 660, which contacts and presses against the pressing belt 65, constructed of a crown portion E1, that is, a convex portion, and an inverted crown portion E2, that is, a concave portion, alternately provided in a longitudinal direction of the pressing pad 66 parallel to the axial direction of the fixing roller 61. For example, the elastic layer 66*b* of the pressing pad 66 includes a plurality of crown portions E1 and a plurality of inverted crown portions E2 alternately provided in the longitudinal direction of the pressing pad 66; thus, the pressing face 660 of the pressing pad 66 is waved over the longitudinal direction of the pressing pad 66. That is, the thickness of the elastic layer 66*b* of the pressing pad 66 varies in the longitudinal direction of the pressing pad 66, thus producing the crown portion E1 and the inverted crown portion E2 which wave the pressing face 660.

As illustrated in FIG. 9, according to this exemplary embodiment, the crown portions E1 and the inverted crown portions E2 are provided at least over the maximum width W of the maximum recording medium P that the image forming apparatus 1 depicted in FIG. 2 can accommodate. That is, they are provided at least over a portion of the pressing pad 66 over which the maximum recording medium passes. Alternatively, they may be provided over a part of the maximum width W of the maximum recording medium P.

When the pressing pad 66 presses the pressing belt 65 against the fixing roller 61, the crown portion C1 of the fixing roller 61 indirectly contacts the inverted crown portion E2 of the pressing pad 66 via the pressing belt 65 and at the same time the inverted crown portion C2 of the fixing roller 61 indirectly contacts the crown portion E1 of the pressing pad 66 via the pressing roller 65. With this configuration, the fixing roller 61 and the pressing pad 66 sandwich the pressing belt 65 at the fixing nip N, waving the pressing belt 65 there.

Although FIG. 9 illustrates a plurality of crown portions C1 and a plurality of inverted crown portions C2 of the fixing roller 61 and a plurality of crown portions E1 and a plurality of inverted crown portions E2 of the pressing pad 66, the fixing roller 61 may have at least one crown portion C1 and at least one inverted crown portion C2; similarly the pressing pad 66 may have at least one crown portion E1 and at least one inverted crown portion E2. However, it is to be noted that, when the pressing pad 66 presses the pressing belt 65 against the fixing roller 61, the crown portion C1 of the fixing roller 61 indirectly contacts the inverted crown portion E2 of the pressing pad 66 via the pressing belt 65 and at the same time the inverted crown portion C2 of the fixing roller 61 indirectly contacts the crown portion E1 of the pressing pad 66 via the pressing belt 65. Thus, the number of the crown portions C1 is equal to the number of the inverted crown portions E2; the number of the crown portions E1 is equal to the number of the inverted crown portions C2.

Similar to the crown portions C1 and D1 and the inverted crown portions C2 and D2 of the fixing roller 61 and the pressing roller 62 of the fixing device 27 shown in FIGS. 4 and 5, the crown portions C1 and E1 and the inverted crown portions C2 and E2 of the fixing roller 61 and the pressing pad 66 are curved, for example, arc-shaped or sine-waved along the axial direction of the fixing roller 61 and the longitudinal direction of the pressing pad 66.

Further, similar to the above-described exemplary embodiment shown in FIG. 7, when the pressing pad 66 presses the pressing belt 65 against the fixing roller 61 with load applied to the fixing nip N, the wave height H from the wave trough U of the inverted crown portions C2 and E2 to the wave crest Q of the crown portions C1 and E1 is preferably in a range of from about 0.16 mm to about 0.80 mm at the fixing nip N.

When the compression rate of the elastic layers 61*b* and 66*b* is set to 20 percent in the load state in which the fixing nip N is applied with load by the pressing pad 66 that presses the pressing belt 65 against the fixing roller 61, the wave height H in the non-load state in which the fixing nip N is not applied with load by the pressing pad 66, which is greater than the wave height H in the load state in a range of from about 0.16 mm to about 0.80 mm by 1.25 times, is in a range of from about 0.20 mm to about 1.00 mm.

Although FIG. 9 omits illustration of the configuration of the fixing device 27S that attaches the fixing roller 61 and the pressing pad 66 to the side plates 71 and 72 of the image forming apparatus 1, similar to the configuration shown in FIG. 6, the fixing roller 61 and the pressing pad 66 are fixedly mounted to the side plate 71 immovably in the axial direction and the longitudinal direction thereof at the common lateral end, that is, the left lateral end in FIG. 6, in the axial direction and the longitudinal direction thereof; by contrast, another lateral end, that is, the right lateral end in FIG. 6, of the fixing roller 61 and the pressing pad 66 in the axial direction and the longitudinal direction thereof is movable in the axial direction and the longitudinal direction thereof.

Referring to FIGS. 6 and 9, the following describes the advantages attained by the fixing devices 27 and 27S described above.

In each of the fixing devices 27 and 27S, the crown portions C1, D1, and E1 and the inverted crown portions C2, D2, and E2 of the fixing roller 61, the pressing roller 62, and the pressing pad 66, respectively, wave the fixing nip N in the axial direction of the fixing roller 61. Accordingly, as the recording medium P passes through the fixing nip N, it waves along the waved fixing nip N, enhancing the apparent rigidity of the recording medium P substantially. For example, as the recording medium P is discharged from the fixing nip N, the enhanced apparent rigidity of the recording medium P can prevent the recording medium P from being wound around the fixing roller 61.

Referring to FIGS. 6, 7, 10, 11, 12A and 12B, the following describes experiments for examining the relation between the number of waves of the fixing nip N and the apparent rigidity of the recording medium P discharged from the fixing nip N.

The experiments used two types of experimental fixing devices having the configuration equivalent to that of the fixing device 27 shown in FIG. 6: an experimental fixing device X1 including three crown portions and three inverted crown portions; and an experimental fixing device X2 including seven crown portions and seven inverted crown portions. In addition, a conventional fixing device CV including a fixing roller and a pressing roller which have neither crown portions nor inverted crown portions was used as a comparative fixing device.

In the experimental fixing devices X1 and X2, the height S1 (e.g., the positive amplitude) and the depth S2 (e.g., the negative amplitude) of the crown portions and the inverted crown portions were 0.2 mm in the non-load state in which the fixing nip N is applied with no load by the pressing roller 62 pressed against the fixing roller 61. In the experimental fixing devices X1 and X2 as well as the conventional fixing device CV, various recording media P having paper weight, that is, weight per unit area, of 64 g/m$^2$, 69 g/m$^2$, and 90 g/m$^2$ were used to measure the apparent rigidity of the recording media P.

Figure 10:
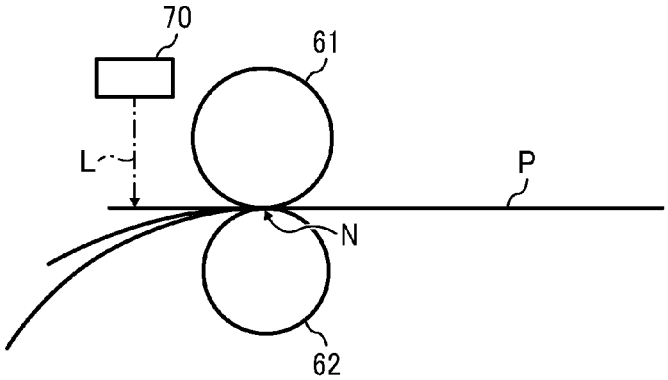
FIG. 10 is a vertical sectional view of the fixing roller and the pressing roller shown in FIGS. 4 and 5 used for experiments.

Referring to FIG. 10, a detailed description is now given of a method for measuring the apparent rigidity of the recording media P of various paper weights described above.

FIG. 10 is a vertical sectional view of the fixing roller 61 and the pressing roller 62. As illustrated in FIG. 10, a recording medium P is conveyed through the fixing nip N formed between the fixing roller 61 and the pressing roller 62. When a laser beam L emitted by a displacement measurement device 70 irradiates a leading edge of the recording medium P, the recording medium P is stopped. After vibration of the stopped recording medium P is ceased, the displacement measurement device 70 emits a laser beam L onto the bent recording medium P, measuring displacement of the recording medium P. Thereafter, the recording medium P is conveyed for a predetermined distance, and then the displacement measurement device 70 emits a laser beam L onto the recording medium P again, measuring displacement of the recording medium P. Based on the displacement of the recording medium P measured as described above the apparent rigidity of the recording medium P is calculated.

Figure 11:
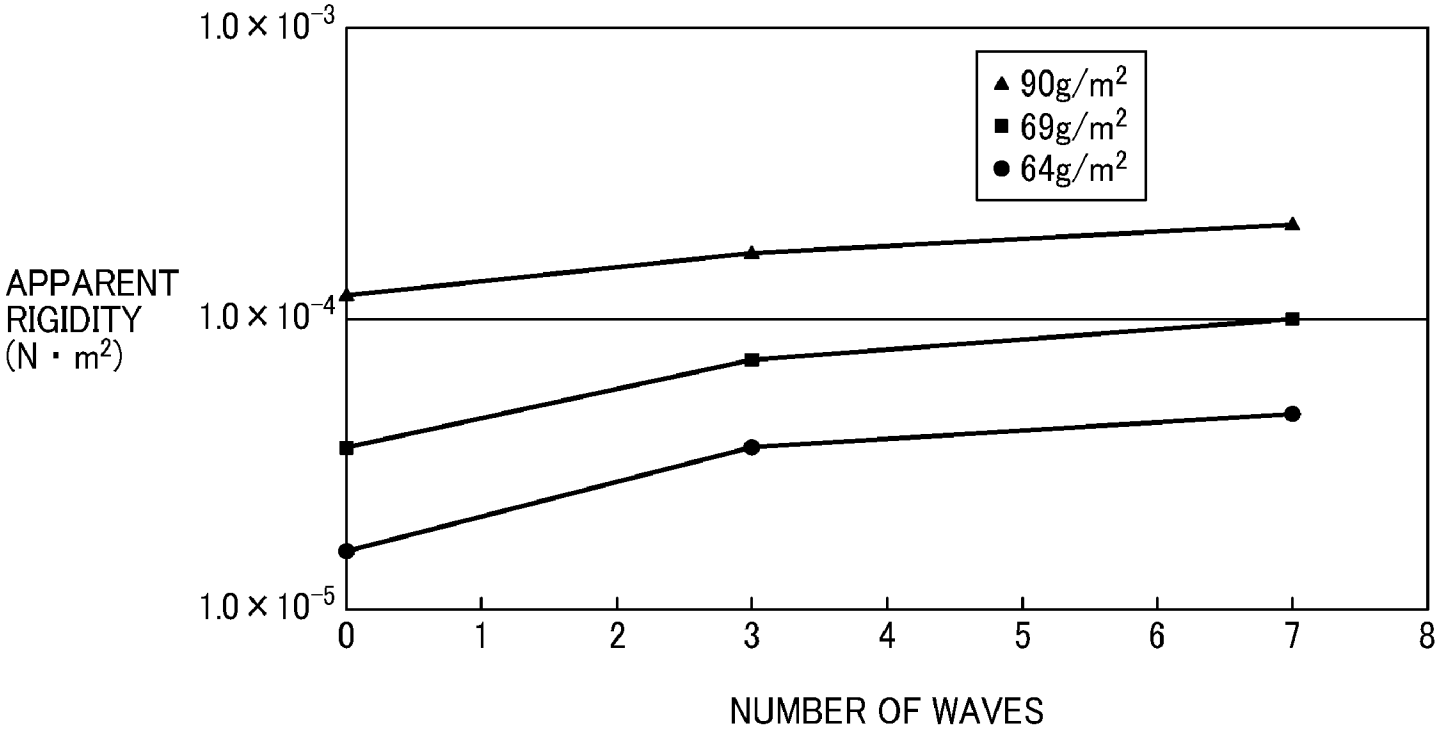
FIG. 11 is a graph showing the relation between the number of waves of a fixing nip formed between the fixing roller and the pressing roller shown in FIG. 10 and the apparent rigidity of recording media of various paper weights.

FIG. 11 is a graph showing the relation between the number of waves of the fixing nip N and the apparent rigidity of recording media P of various paper weights. In FIG. 11, the vertical axis defines the apparent rigidity of the recording medium P; the horizontal axis defines the number of waves of the fixing nip N. The number of waves of the fixing nip N defines the number of crown portions, that is, the number of inverted crown portions. For example, zero wave of the fixing nip N means that both the fixing roller 61 and the pressing roller 62 have neither crown portions nor inverted crown portions. Three waves of the fixing nip N means that one of the fixing roller 61 and the pressing roller 62 has three crown portions and the other one has three inverted crown portions. In the graph shown in FIG. 11, the solid triangles show measurement values of the recording medium P having the paper weight of 90 $g/m^2$. The solid squares show measurement values of the recording medium P having the paper weight of 69 $g/m^2$. The solid circles show measurement values of the recording medium P having the paper weight of 64 $g/m^2$.

The graph shows that the experimental fixing device X1 with three waves of the fixing nip N and the experimental fixing device X2 with seven waves of the fixing nip N provide the greater apparent rigidity of the recording media P of various paper weights compared to the conventional fixing device CV with zero wave of the fixing nip N. Specifically, the experimental fixing device X2 with seven waves of the fixing nip N provides the greater apparent rigidity of the recording media P of various paper weights than the experimental fixing device X1 with three waves of the fixing nip N. Namely, as the number of waves of the fixing nip N increases, the apparent rigidity of the recording media P of various paper weights increases. The experimental results shown in FIG. 11 verify the advantages of the fixing devices 27 and 27S depicted in FIGS. 3 and 8, respectively, which are equivalent to the experimental fixing devices X1 and X2, that is, enhancement of the apparent rigidity of the recording media P of various paper weights.

As described above, the wave height H from the wave trough U of the inverted crown portions C2 and D2 to the wave crest Q of the crown portions C1 and D1 depicted in FIG. 7 is preferably not smaller than about 0.16 mm in the load state in which the pressing roller 62 is pressed against the fixing roller 61. This is because, when the wave height H is smaller than about 0.16 mm, waves of the recording medium P passing through the fixing nip N are downsized, that is, made gentle; they cannot provide the apparent rigidity of the recording medium P strong enough to separate the recording medium P from the fixing roller 61 precisely. Conversely, when the wave height H exceeds about 0.8 mm, the rotation speed of the fixing roller 61 and the pressing roller 62 differs substantially between the crown portions C1 and D1 and the inverted crown portions C2 and D2, creasing the recording medium P. Therefore, the wave height H is set in a range of from about 0.16 mm to about 0.80 mm to attain the apparent rigidity of the recording medium P strong enough to prevent the recording medium P from being wound around the fixing roller 61 precisely and at the same time to prevent the recording medium P from creasing, resulting in formation of a proper toner image.

Figure 12A:
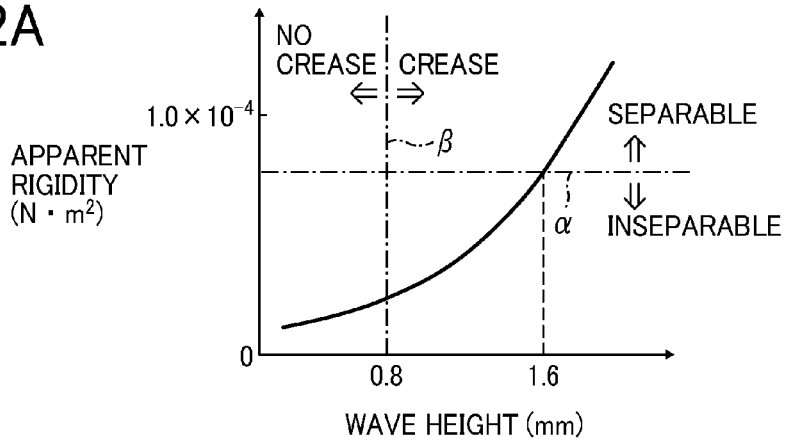
FIG. 12A is a graph showing experimental results of one configuration of the fixing roller and the pressing roller shown in FIG. 10.
Figure 12B:
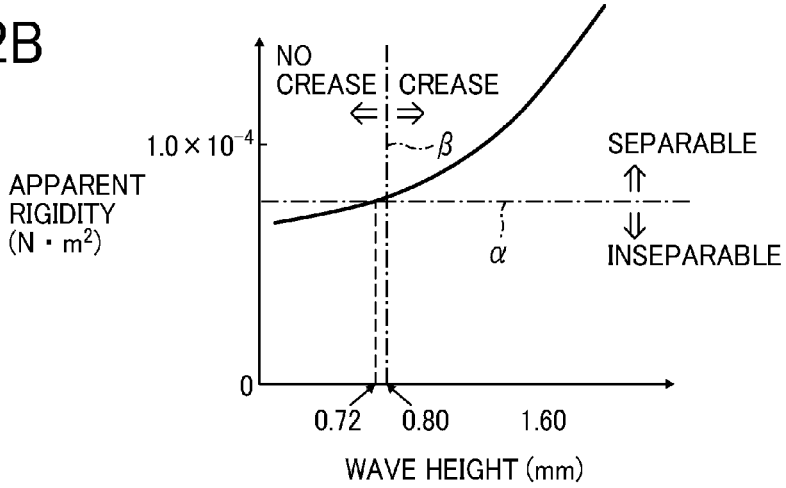
FIG. 12B is a graph showing experimental results of another configuration of the fixing roller and the pressing roller shown in FIG. 10.

Referring to FIGS. 12A and 12B, a detailed description is now given of experiments for comparing separation performance of the recording medium P between a configuration CF1 in which each of the fixing roller 61 and the pressing roller 62 has one crown portion or one inverted crown portion and a configuration CF2 in which each of the fixing roller 61 and the pressing roller 62 has one crown portion and one inverted crown portion.

FIG. 12A is a graph showing experimental results of the configuration CF1. FIG. 12B is a graph showing experimental results of the configuration CF2. In FIGS. 12A and 12B, the vertical axis defines the apparent rigidity of the recording medium P and the horizontal axis defines the wave height H from the wave trough U of the inverted crown portions C2 and D2 to the wave crest Q of the crown portions C1 and D1 (depicted in FIG. 7) at the fixing nip N in the load state in which the pressing roller 62 is pressed against the fixing roller 61. In FIGS. 12A and 12B, a border alpha indicated by the broken line defines a border of the apparent rigidity of the recording medium P over which the recording medium P is separable from the fixing roller 61 properly and under which it is not properly separable from the fixing roller 61. On the other hand, a border beta indicated by the broken line defines a border of the wave height H from the wave trough U of the inverted crown portions C2 and D2 to the wave crest Q of the crown portions C1 and D1 over which the recording medium P may be creased and under which it may not be creased.

Thus, for example, when the apparent rigidity of the recording medium P is greater than the border alpha, the recording medium P is separable from the fixing roller 61 properly. By contrast, when the apparent rigidity of the recording medium P is smaller than the border alpha, the recording medium P is inseparable from the fixing roller 61 properly. Further, when the wave height H from the wave trough U of the inverted crown portions C2 and D2 to the wave crest Q of the crown portions C1 and D1 is greater than the border beta, the recording medium P may be creased. By contrast, when the wave height H from the wave trough U of the inverted crown portions C2 and D2 to the wave crest Q of the crown portions C1 and D1 is smaller than the border beta, the recording medium P may not be creased.

As illustrated in FIG. 12A, with the configuration CF1, in order to separate the recording medium P from the fixing roller 61 properly with the apparent rigidity of the recording medium P over the border alpha, it is required to set the wave height H from the wave trough U of the inverted crown portions C2 and D2 to the wave crest Q of the crown portions C1 and D1 greater than about 1.6 mm, creasing the recording medium P. Conversely, as illustrated in FIG. 12B, with the configuration CF2, the apparent rigidity of the recording medium P is enhanced substantially compared to the configuration CF1 even with the identical wave height H. For example, the apparent rigidity of the recording medium P can be over the border alpha with the wave height H in a range of from about 0.72 mm to about 0.80 mm that does not crease the recording medium P. Thus, the configuration CF2 can facilitate separation of the recording medium P from the fixing roller 61 and at the same time prevent creasing of the recording medium P, resulting in formation of a high-quality toner image on the recording medium P.

The experimental results described above show that the configuration CF2 enhances the apparent rigidity of the recording medium P substantially compared to the configuration CF1. Accordingly, the exemplary embodiments of the present invention employ the configuration CF2, that is, the configuration of the fixing device 27 shown in FIG. 6 in which the fixing roller 61 has at least one crown portion C1 and at least one inverted crown portion C2 and the pressing roller 62 has at least one crown portion D1 and at least one inverted crown portion D2; or the configuration of the fixing device 27S shown in FIG. 9 in which the fixing roller 61 has at least one crown portion C1 and at least one inverted crown portion C2 and the pressing pad 66 has at least one crown portion E1 and at least one inverted crown portion E2. Further, as described above, as the number of the crown portions and the inverted crown portions increases, the apparent rigidity of the recording medium P increases, thus facilitating separation of the recording medium P from the fixing roller 61.

It is to be noted that, although the experimental results shown in FIGS. 12A and 12B verify enhancement of the apparent rigidity of the recording medium P with the configurations CF1 and CF2 using the fixing roller 61 and the pressing roller 62 shown in FIG. 10, which are equivalent to the configuration of the fixing device 27 shown in FIG. 3, such enhancement of the apparent rigidity of the recording medium P can be attained with the configuration of the fixing device 27S shown in FIG. 8 as well as other configuration described below.

On the other hand, conventional fixing devices may include a fixing roller and a pressing roller, one of which may be a waved roller having a crown portion or an inverted crown portion while another one of them is a straight roller. With such configuration, when the waved pressing roller is pressed against the straight fixing roller to form a fixing nip therebetween, the fixing nip is applied with greater pressure locally, generating variation in pressure therebetween over an axial direction thereof. Accordingly, when a recording medium P passes through the fixing nip, a part of the recording medium P receives greater pressure that applies increased gloss to a toner image on the recording medium P while other part of the recording medium P receives smaller pressure that applies decreased gloss to the toner image on the recording medium P, resulting in variation in gloss of the toner image on the recording medium P and formation of the faulty toner image.

To address these problems, the fixing devices 27 and 27S depicted in FIGS. 6 and 9, respectively, according to the above-described exemplary embodiments include a fixing rotary body (e.g., the fixing roller 61) and a pressing member (e.g., the pressing roller 62 or the pressing pad 66) pressed against the fixing rotary body to form a fixing nip therebetween; the fixing rotary body has a convex crown portion and a concave inverted crown portion that correspond to a concave inverted crown portion and a convex crown portion of the pressing member, minimizing variation in pressure between the fixing rotary body and the pressing member at the fixing nip. As a result, a high-quality toner image can be formed on a recording medium with minimized variation in gloss of the toner image fixed on the recording medium.

As described above, in the configuration shown in FIG. 10 equivalent to the fixing device 27 shown in FIG. 3, the crown portion C1 and the inverted crown portion C2 of the fixing roller 61 correspond to the inverted crown portion D2 and the crown portion D1 of the pressing roller 62, minimizing variation in pressure between the fixing roller 61 and the pressing roller 62 at the fixing nip N. However, when the fixing roller 61 is heated to the fixing temperature, it expands thermally in the axial direction thereof. Simultaneously, the pressing roller 62 receives heat from the fixing roller 61, expanding thermally in the axial direction thereof. If the crown portion C1 and the inverted crown portion C2 of the fixing roller 61 are displaced from the corresponding inverted crown portion D2 and the corresponding crown portion D1 of the pressing roller 62 by the thermal expansion of the fixing roller 61 and the pressing roller 62, pressure between the fixing roller 61 and the pressing roller 62 may vary at the fixing nip N.

Figure 13:
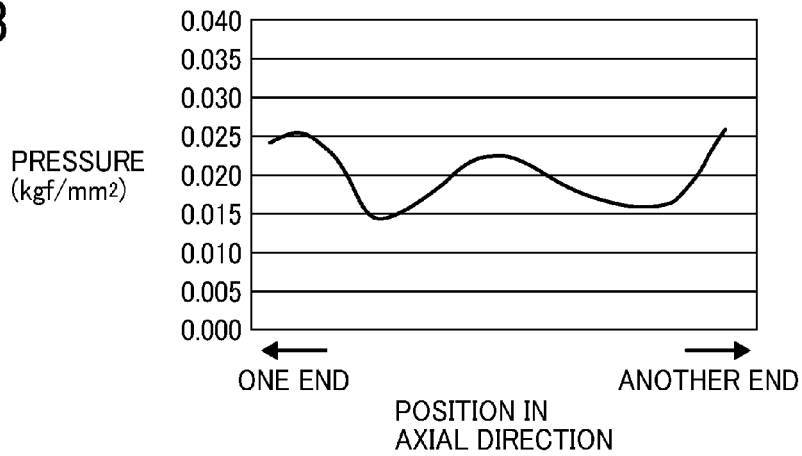
FIG. 13 is a graph showing the relation between the position of the fixing roller shown in FIG. 10 in an axial direction thereof and the pressure between the fixing roller and the pressing roller shown in FIG. 10.

FIG. 13 is a graph showing the relation between the position of the fixing roller 61 in the axial direction thereof and the pressure between the fixing roller 61 and the pressing roller 62 at the fixing nip N when the crown portion C1 and the inverted crown portion C2 of the fixing roller 61 are displaced from the corresponding inverted crown portion D2 and the corresponding crown portion D1 of the pressing roller 62 in the axial direction thereof. When the pressing roller 62 is pressed against the fixing roller 61 that is displaced from the pressing roller 62 in the axial direction thereof, the fixing nip N is applied with greater pressure and smaller pressure alternately from one end to another end in the axial direction of the fixing roller 61 as illustrated in FIG. 13.

Figure 14:
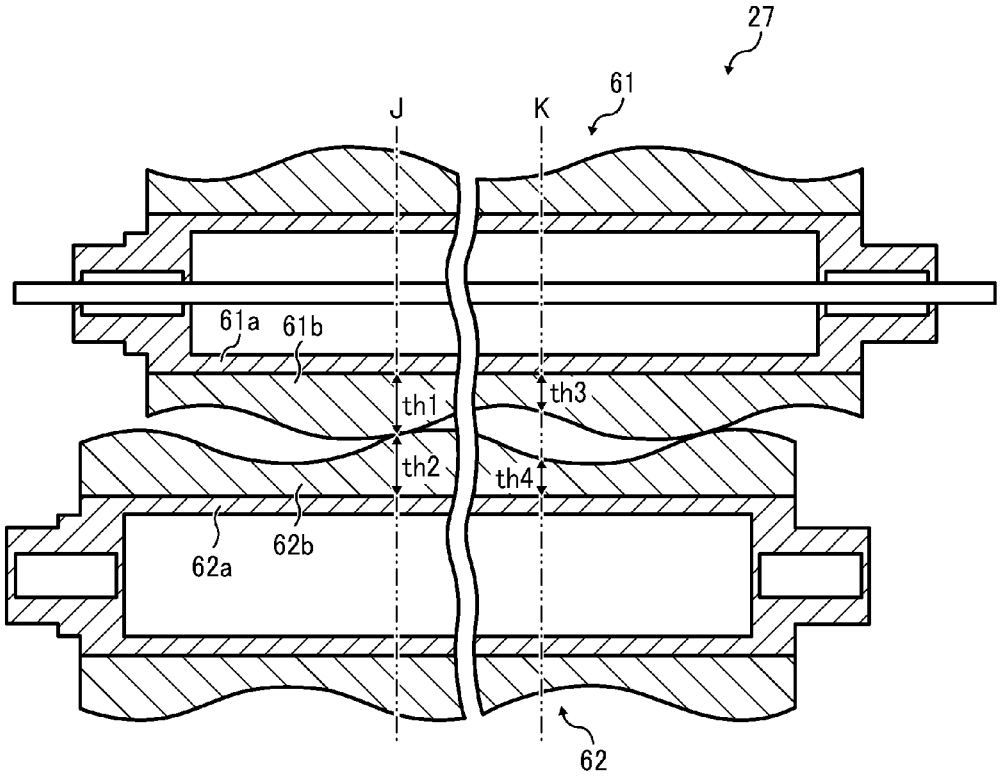
FIG. 14 is a horizontal sectional view of the fixing device illustrating the fixing roller and the pressing roller shown in FIG. 6 displaced from the fixing roller in the axial direction thereof.

FIG. 14 is a horizontal sectional view of the fixing device 27 illustrating the fixing roller 61 and the pressing roller 62 displaced from the fixing roller 61 in the axial direction thereof.

As illustrated in FIG. 14, a gap between the straight core 61*a* of the fixing roller 61 and the straight core 62*a* of the pressing roller 62 is identical throughout the axial direction of the fixing roller 61. By contrast, the combined thickness of the elastic layer 61*b* of the fixing roller 61 and the elastic layer 62*b* of the pressing roller 62 disposed between the core 61*a* and the core 62*b* varies in the axial direction of the fixing roller 61. For example, the combined thickness of a thickness th1 of the elastic layer 61*b* and a thickness th2 of the elastic layer 62*b* on a vertical line J is greater than the combined thickness of a thickness th3 of the elastic layer 61*b* and a thickness th4 of the elastic layer 62*b* on a vertical line K. Under such condition, when the pressing roller 62 is pressed against the fixing roller 61, an amount of compression of the elastic layers 61*b* and 62*b* on the line J is greater than that on the line K, increasing pressure between the fixing roller 61 and the pressing roller 62 on the line J. Thus, when the pressing roller 62 is pressed against the fixing roller 61 displaced from the pressing roller 62 in the axial direction thereof, pressure therebetween may vary depending on the combined thickness of the elastic layers 61*b* and 62*b* in the axial direction thereof.

Figure 15:
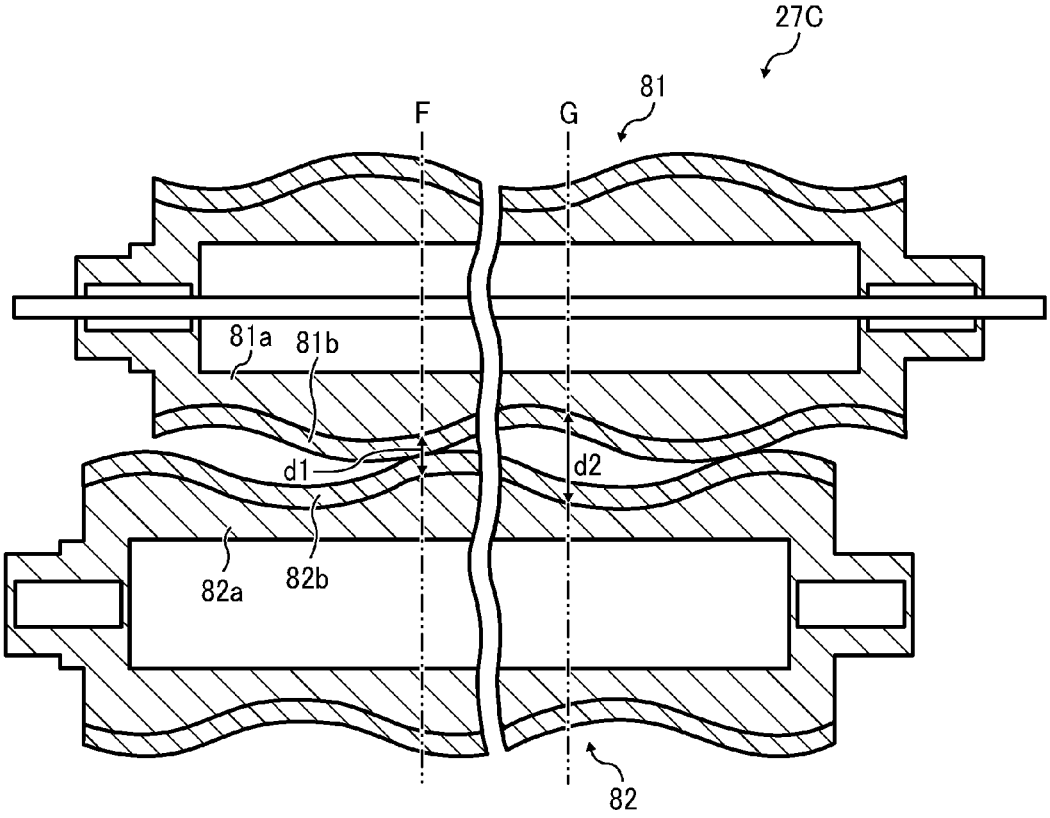
FIG. 15 is a horizontal sectional view of a comparative fixing device illustrating a fixing roller and a pressing roller displaced from the fixing roller in an axial direction thereof.

FIG. 15 is a horizontal sectional view of a comparative fixing device 27C illustrating a fixing roller 81 and a pressing roller 82 displaced from the fixing roller 81 in an axial direction of the fixing roller 81 and the pressing roller 82. The comparative fixing device 27C is different from the fixing device 27 depicted in FIG. 6 in that a core 81*a* of the fixing roller 81 and a core 82*a* of the pressing roller 82 have a thickness varying in the axial direction thereof, thus producing crown portions and inverted crown portions. Conversely, an elastic layer 81*b* and a release layer disposed thereon of the fixing roller 81 and an elastic layer 82*b* and a release layer disposed thereon of the pressing roller 82 have a uniform thickness in the axial direction of the fixing roller 81 and the pressing roller 82.

Similar to the fixing device 27 shown in FIG. 14, also in the comparative fixing device 27C, when the pressing roller 82 is pressed against the fixing roller 81 displaced from the pressing roller 82 in the axial direction thereof, pressure therebetween may vary in the axial direction thereof. For example, the combined thickness of the elastic layer 81*b* of the fixing roller 81 and the elastic layer 82*b* of the pressing roller 82 disposed between the core 81*a* and the core 82*a* is uniform in the axial direction of the fixing roller 81. By contrast, a gap d1 between the core 81*a* and the core 82*a* on a vertical line F is smaller than a gap d2 between the core 81*a* and the core 82*a* on a vertical line G. Under such condition, when the pressing roller 82 is pressed against the fixing roller 81, an amount of compression of the elastic layers 81*b* and 82*b* on the line F is greater than that on the line G, increasing pressure between the fixing roller 81 and the pressing roller 82 on the line F. Thus, when the pressing roller 82 is pressed against the fixing roller 81 displaced from the pressing roller 82 in the axial direction thereof, pressure therebetween may vary depending on the gap between the cores 81*a* and 82*a* in the axial direction thereof.

As described above by referring to FIGS. 14 and 15, both in the fixing device 27 according to the exemplary embodiments of the present invention and in the comparative fixing device 27C, when the pressing roller is pressed against the fixing roller displaced from the pressing roller in the axial direction thereof in such a manner that the crown portions and the inverted crown portions of the fixing roller do not fit into the inverted crown portions and the crown portions of the pressing roller, pressure between the fixing roller and the pressing roller at the fixing nip N may vary in the axial direction thereof. However, a differential in pressure between the fixing roller and the pressing roller at the fixing nip N with respect to an amount of displacement of the fixing roller from the pressing roller in the axial direction thereof is different between the fixing device 27 and the comparative fixing device 27C.

Figure 16:
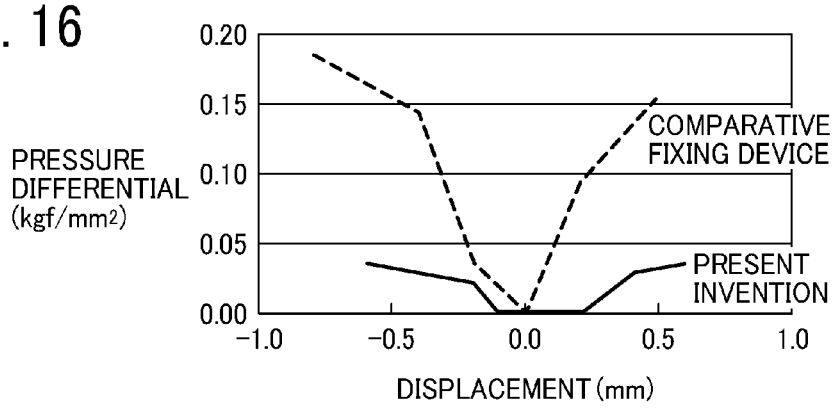
FIG. 16 is a graph showing the relation between the amount of displacement of the fixing roller from the pressing roller in the axial direction thereof and the differential in pressure between the fixing roller and the pressing roller in the fixing device shown in FIG. 14 and the comparative fixing device shown in FIG. 15.

FIG. 16 is a graph showing the relation between the amount of displacement of the fixing roller from the pressing roller in the axial direction thereof and the differential in pressure between the fixing roller and the pressing roller at the fixing nip N in the fixing device 27 depicted in FIG. 14 and the comparative fixing device 27C depicted in FIG. 15. The "differential in pressure between the fixing roller and the pressing roller at the fixing nip N" defines a differential between a greatest pressure and a smallest pressure applied between the fixing roller and the pressing roller at the fixing nip N over the axial direction thereof. It is to be noted that bending of the core 61*a* of the fixing roller 61 and the core 62*a* of the pressing roller 62 depicted in FIG. 14 and the core 81*a* of the fixing roller 81 and the core 82*a* of the pressing roller 82 at a portion where such differential between the greatest pressure and the smallest pressure arises is not considered because it is slight enough to be ignored.

As shown in FIG. 16, under the identical amount of displacement of the fixing roller from the pressing roller in the axial direction thereof, the differential between the greatest pressure and the smallest pressure in the fixing device 27, which is indicated by the solid line, is smaller than that in the comparative fixing device 27C, which is indicated by the broken line. Thus, the fixing device 27 tends to decrease the differential between the greatest pressure and the smallest pressure with respect to the amount of displacement of the fixing roller from the pressing roller in the axial direction thereof, compared to the comparative fixing device 27C.

Figure 17:
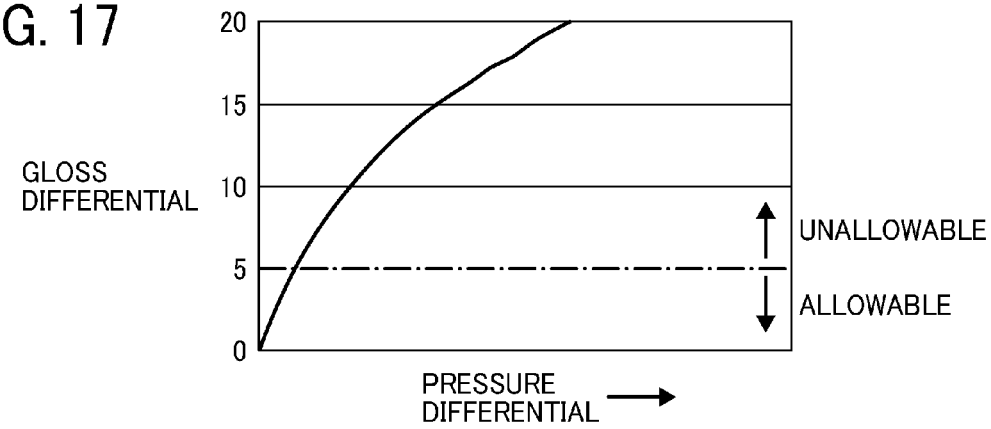
FIG. 17 is a graph showing the relation between the differential between the greatest pressure and the smallest pressure applied between the fixing roller and the pressing roller in the fixing device shown in FIG. 14 and the differential in gloss of a toner image fixed on a recording medium.

FIG. 17 is a graph showing the relation between the differential between the greatest pressure and the smallest pressure and the differential in gloss of the toner image fixed on the recording medium P.

As shown in FIG. 17, as the differential between the greatest pressure and the smallest pressure increases, the differential in gloss increases. However, under the differential in gloss of 5, neither a toner image with high gloss nor a toner image with low gloss is recognized as image noise. That is, the differential in gloss of 5 or smaller is allowable. It is to be noted that the "differential in gloss" defines a differential in gloss between a highest gloss and a lowest gloss of the identical toner image, which was measured with a gloss meter model PG-1M manufactured by NIPPON DENSHOKU INDUSTRIES CO., LTD. at a measurement angle (e.g., an incident angle) of 60 degrees.

Figure 18:
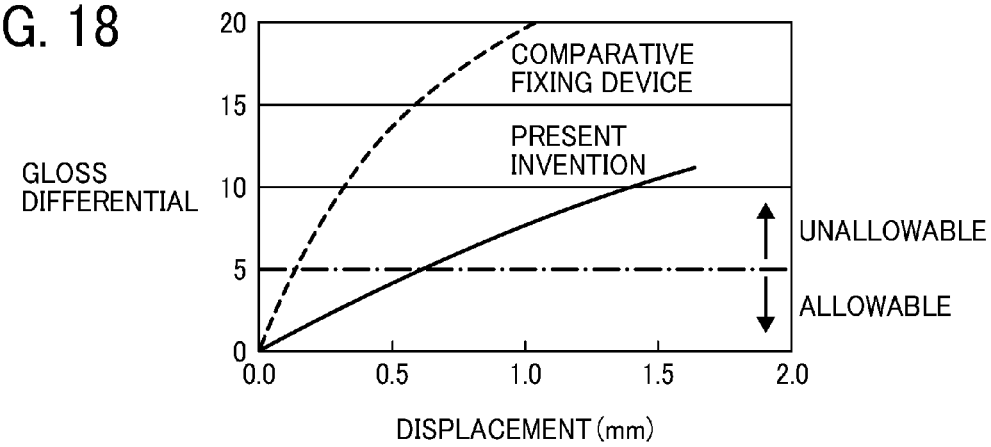
FIG. 18 is a graph showing the relation between the amount of displacement of the fixing roller from the pressing roller in the axial direction thereof in the fixing device shown in FIG. 14 and the comparative fixing device shown in FIG. 15 and the differential in gloss of the toner image fixed on the recording medium.

FIG. 18 is a graph showing the relation between the amount of displacement of the fixing roller from the pressing roller in the axial direction thereof and the differential in gloss of the toner image fixed on the recording medium P.

As shown in FIG. 18, under the identical amount of displacement of the fixing roller from the pressing roller in the axial direction thereof, the differential in gloss of the fixing device 27, which is indicated by the solid line, is smaller than that of the comparative fixing device 27C, which is indicated by the broken line. It is because, under the identical amount of displacement of the fixing roller from the pressing roller in the axial direction thereof, the differential between the greatest pressure and the smallest pressure of the fixing device 27 is smaller than that of the comparative fixing device 27C as shown in FIG. 16, thus decreasing the differential in gloss of the toner image.

As described above, the fixing device 27 with the elastic layer 61*b* of the fixing roller 61 and the elastic layer 62*b* of the pressing roller 62, in which the thickness of the elastic layers 61*b* and 62*b* varies in the axial direction of the fixing roller 61 and the pressing roller 62, decreases the differential between the greatest pressure and the smallest pressure at the fixing nip N caused by displacement of the fixing roller 61 from the pressing roller 62 in the axial direction thereof, compared to the comparative fixing device 27C with the core 81*a* of the fixing roller 81 and the core 82*a* of the pressing roller 82, in which the thickness of the cores 81*a* and 82*a* varies in the axial direction of the fixing roller 81 and the pressing roller 82, minimizing variation in gloss of the toner image. Similarly, the fixing device 27S depicted in FIG. 9, which uses the pressing pad 66 and the pressing belt 65 instead of the pressing roller 62, has the elastic layer 61*b* of the fixing roller 61 and the elastic layer 66*b* of the pressing pad 66 with the thickness of the elastic layers 61*b* and 66*b* varying in the axial direction of the fixing roller 61 and the longitudinal direction of the pressing pad 66. Accordingly, the fixing device 27S decreases the differential between the greatest pressure and the smallest pressure at the fixing nip N with respect to the amount of displacement of the fixing roller 61 from the pressing pad 66 in the axial direction thereof, compared to a comparative fixing device having the core 61*a* of the fixing roller 61 and the core 66*a* of the pressing pad 66 with the thickness of the cores 61*a* and 66*a* varying in the axial direction in the fixing roller 61 and the longitudinal direction of the pressing pad 66, thus minimizing variation in gloss of the toner image.

Further, as shown in FIG. 18, the fixing device 27 minimizes the differential in gloss of the toner image to below 5 if the amount of displacement of the fixing roller 61 from the pressing roller 62 in the axial direction thereof is within about plus or minus 0.5 mm, rendering the differential in gloss unrecognizable as image noise. Accordingly, in the fixing device 27 shown in FIG. 6, one lateral end (e.g., the left lateral end) of the fixing roller 61 and one lateral end (e.g., the left lateral end) of the pressing roller 62 are attached to the side plate 71 immovably in the axial direction of the fixing roller 61 and the pressing roller 62; by contrast, another lateral end (e.g., the right lateral end) of the fixing roller 61 and another lateral end (e.g., the right lateral end) of the pressing roller 62 are attached to the side plate 72 movably in the axial direction of the fixing roller 61 and the pressing roller 62. Consequently, even when the fixing roller 61 thermally expands in the axial direction thereof, the pressing roller 62 also expands or displaces in the same direction in which the fixing roller 61 expands, minimizing displacement of the crown portions C1 and the inverted crown portions C2 of the fixing roller 61 from the corresponding inverted crown portions D2 and the corresponding crown portions D1 of the pressing roller 62, and therefore minimizing variation in pressure between the fixing roller 61 and the pressing roller 62 contacting each other at the fixing nip N.

For example, when the fixing roller 61, having the core 61*a* made of aluminum with a length of about 240 mm in the axial direction thereof and a linear thermal expansion coefficient of about $2.42\times10^{-6}$/° C., is heated from about 20 degrees centigrade to about 180 degrees centigrade, the fixing roller 61 thermally expands in the axial direction thereof by about 0.933 mm. Further, the pressing roller 62, which is also heated to the substantially identical temperature as the fixing roller 61, expands by almost 1.000 mm. Under such condition, the left lateral end of each of the fixing roller 61 and the pressing roller 62 is attached to the side plate 71 immovably in the axial direction of the fixing roller 61 and the pressing roller 62 as shown in FIG. 6; by contrast, the right lateral end of each of the fixing roller 61 and the pressing roller 62 is attached to the side plate 72 movably in the axial direction thereof, decreasing the amount of displacement of the fixing roller 61 from the pressing roller 62 in the axial direction thereof within about 0.5 mm.

As described above, the fixing device 27 depicted in FIG. 6, in which the left lateral end of each of the fixing roller 61 and the pressing roller 62 is immovable while the right lateral end is movable in the axial direction thereof, decreases displacement of the fixing roller 61 from the pressing roller 62 in the axial direction thereof due to thermal expansion, minimizing variation in gloss of the toner image fixed on the recording medium P due to variation in pressure between the fixing roller 61 and the pressing roller 62.

Similarly, the fixing device 27S depicted in FIG. 9, in which the left lateral end of each of the fixing roller 61 and the pressing pad 66 is immovable while the right lateral end is movable in the axial direction thereof, decreases displacement of the fixing roller 61 from the pressing pad 66 in the axial direction thereof due to thermal expansion, minimizing variation in gloss of the toner image fixed on the recording medium P due to variation in pressure between the fixing roller 61 and the pressing pad 66.

The above describes the configuration of the fixing devices 27 and 27S that minimizes variation in pressure between the fixing roller 61 and the pressing roller 62 or the pressing pad 66 at the fixing nip N so as to form a high-quality toner image with a uniform gloss on a recording medium P. However, in order to form a toner image with a uniform gloss, it is also important to maintain a uniform temperature at the fixing nip N as well as a uniform pressure. In this aspect, since the fixing roller 61 of the fixing devices 27 and 27S includes the crown portions C1 and the inverted crown portions C2, it has the non-uniform thickness in the axial direction thereof, and therefore the surface temperature of the fixing roller 61 may vary in the axial direction thereof.

Figure 19:
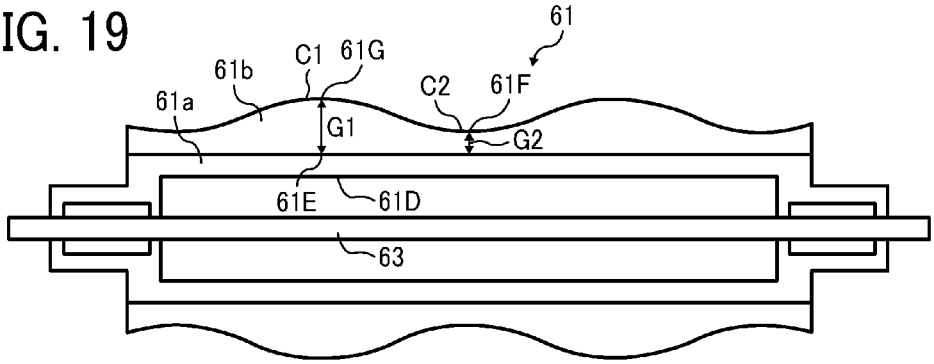
FIG. 19 is a horizontal sectional view of the fixing roller shown in FIG. 4 and a heater lamp disposed inside the fixing roller.
Figure 20:
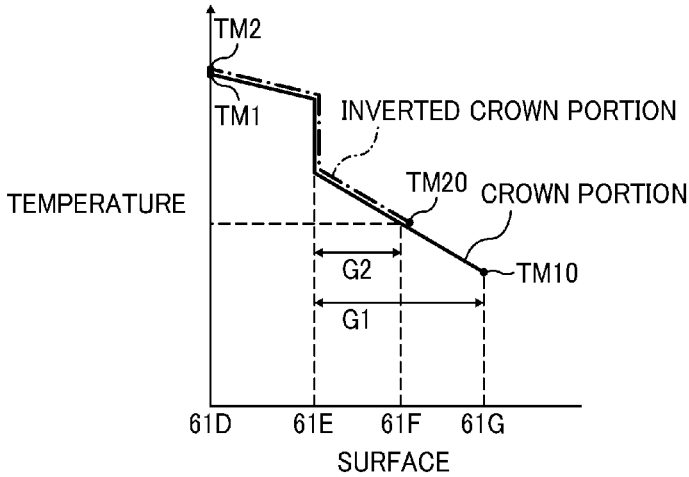
FIG. 20 is a graph showing the relation between various surfaces of the fixing roller shown in FIG. 19 and the temperature of the fixing roller.

Referring to FIGS. 19 and 20, the following describes such variation in the surface temperature of the fixing roller 61 in the axial direction thereof in detail.

FIG. 19 is a horizontal sectional view of the fixing roller 61 and the heater lamp 63 disposed inside the fixing roller 61. FIG. 20 is a graph showing the relation between various surfaces of the fixing roller 61 and the temperature of the fixing roller 61.

As shown in FIG. 19, the fixing roller 61 includes the core 61*a* having a uniform thickness; and the elastic layer 61*b* having a non-uniform thickness and covering the core 61*a*. When the single heater lamp 63 heats an inner circumferential surface of the fixing roller 61 uniformly in the axial direction thereof, the fixing roller 61 has different temperatures at various surfaces thereof: an inner circumferential surface 61D; a border surface 61E between the core 61*a* and the elastic layer 61*b*; an inverted crown portion surface 61F of the inverted crown portion C2 having a smallest thickness G2; and a crown portion surface 61G of the crown portion C1 having a greatest thickness G1, as shown in FIG. 20 in which the temperature of the crown portion C1 is indicated by the solid line and the temperature of the inverted crown portion C2 is indicated by the broken line.

As shown in FIGS. 19 and 20, when the heater lamp 63 heats the inner circumferential surface 61D of the fixing roller 61 to a uniform temperature over the axial direction thereof, a temperature TM1 of the inner circumferential surface 61D of the fixing roller 61 corresponding to the crown portion C1 is equivalent to a temperature TM2 of the inner circumferential surface 61D of the fixing roller 61 corresponding to the inverted crown portion C2. However, since the greatest thickness G1 of the crown portion C1 is greater than the smallest thickness G2 of the inverted crown portion C2, the elastic layer 61*b* of the crown portion C1 draws heat transmitted from the inner circumferential surface 61D before the heat reaches the crown portion surface 61G; a temperature TM10 of the crown portion surface 61G becomes lower than a temperature TM20 of the inverted crown portion surface 61F, varying the surface temperature between the crown portion C1 and the inverted crown portion C2. Consequently, the toner image fixed on the recording medium P has a non-uniform gloss due to the non-uniform temperature of the fixing roller 61, that is, the temperature differential between the inverted crown portion surface 61F and the crown portion surface 61G, degrading quality of the toner image.

Figure 21:
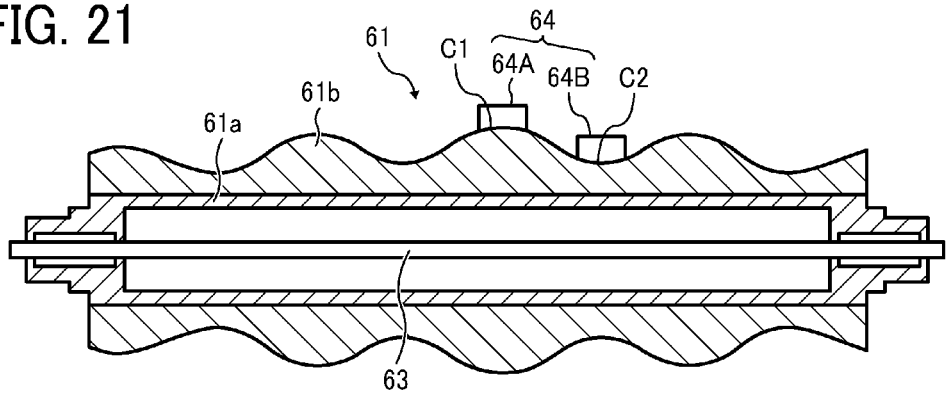
FIG. 21 is a horizontal sectional view of the fixing roller and temperature detectors included in the fixing devices shown in FIGS. 3 and 8.

To address these problems, the fixing devices 27 and 27S include two temperature detectors that detect the surface temperature of the crown portion C1 and the inverted crown portion C2, respectively. FIG. 21 is a horizontal sectional view of the fixing roller 61 faced by such temperature detectors.

As illustrated in FIG. 21, the temperature detector 64 includes two temperature detectors: a first temperature detector 64A that contacts the crown portion C1 and detects the surface temperature of the crown portion C1; and a second temperature detector 64B that contacts the inverted crown portion C2 and detects the surface temperature of the inverted crown portion C2. Based on the temperatures detected by the first temperature detector 64A and the second temperature detector 64B, the controller 15 depicted in FIGS. 3 and 8 controls an amount of heat stored in the elastic layer 61*b* of the fixing roller 61. That is, the fixing devices 27 and 27S adjust the amount of heat stored in the fixing roller 61 based on a differential between the temperature detected by the first temperature detector 64A and the temperature detected by the second temperature detector 64B, thus supplying a sufficient amount of heat to the recording medium P at the fixing nip N. Consequently, the overall gloss of the toner image fixed on the recording medium P is enhanced, rendering variation in gloss of the toner image visually unrecognizable. However, when the recording medium P is supplied with excessive heat, hot offset of the toner image may arise, resulting in formation of a faulty toner image. To address this problem, the controller 15 need to control the amount of heat stored in the fixing roller 61 to prevent hot offset of the toner image. Hot offset of the toner image may arise at the fixing temperature that varies depending on the type of toner of the toner image and the type of the recording medium P, for example, at the fixing temperature higher than about 190 degrees centigrade with the recording medium P having the paper weight of 70 g/m$^2$. Thus, a high-quality toner image is formed at the fixing temperature in a range of from about 145 degrees centigrade to about 190 degrees centigrade.

The controller 15 adjusts the amount of heat stored in the fixing roller 61 in various methods described below based on the differential between the temperature detected by the first temperature detector 64A and the temperature detected by the second temperature detector 64B: a method of changing the fixing temperature of the fixing roller 61; a method of determining the time to heat and at the same time idle the fixing roller 61; and a method of changing the system speed.

As illustrated in FIG. 21, the first temperature detector 64A and the second temperature detector 64B contact the crown portion C1 and the inverted crown portion C2 of the fixing roller 61 to detect the temperature thereof, respectively. Alternatively, the first temperature detector 64A and the second temperature detector 64B may detect the temperature of the crown portion C1 and the inverted crown portion C2 without contacting them, respectively. For example, the first temperature detector 64A and the second temperature detector 64B may be thermistors and thermopiles.

Figure 22:
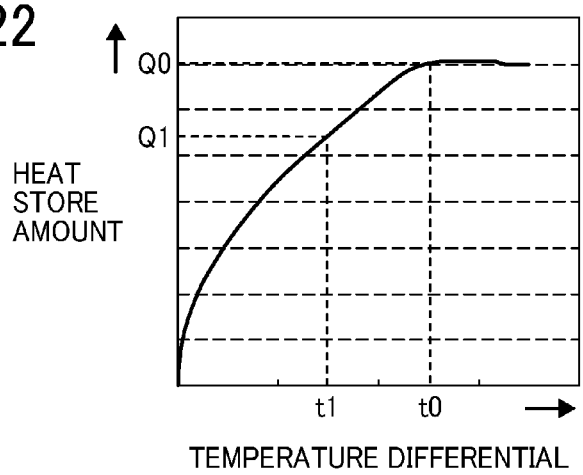
FIG. 22 is a graph showing the relation between the differential between the surface temperatures of the fixing roller detected by the temperature detectors shown in FIG. 21 and the amount of heat stored in the fixing roller.

Referring to FIG. 22, the following describes the method of changing the fixing temperature of the fixing roller 61.

FIG. 22 is a graph showing the relation between the differential between the surface temperature of the crown portion C1 detected by the first temperature detector 64A and the surface temperature of the inverted crown portion C2 detected by the second temperature detector 64B and the amount of heat stored in the fixing roller 61 required to eliminate variation in gloss of the toner image.

As shown in FIG. 22, at a temperature differential t0 between the temperature of the crown portion C1 and the temperature of the inverted crown portion C2, the controller 15 adjusts the amount of heat stored in the fixing roller 61, that is, the fixing temperature of the fixing roller 61, to a store amount Q0 of heat stored in the fixing roller 61. When the recording medium P is conveyed through the fixing nip N while the fixing roller 61 stores the store amount Q0 of heat, the recording medium P is supplied with heat at the fixing nip N enough to enhance the overall gloss of the toner image, making variation in gloss of the toner image visually unrecognizable. Conversely, at a temperature differential t1 between the temperature of the crown portion C1 and the temperature of the inverted crown portion C2, which is smaller than the temperature differential t0, the controller 15 adjusts the amount of heat stored in the fixing roller 61, that is, the fixing temperature of the fixing roller 61, to a store amount Q1 of heat stored in the fixing roller 61, which is smaller than the store amount Q0 corresponding to the temperature differential t0, rendering variation in gloss of the toner image visually unrecognizable.

Figure 23:
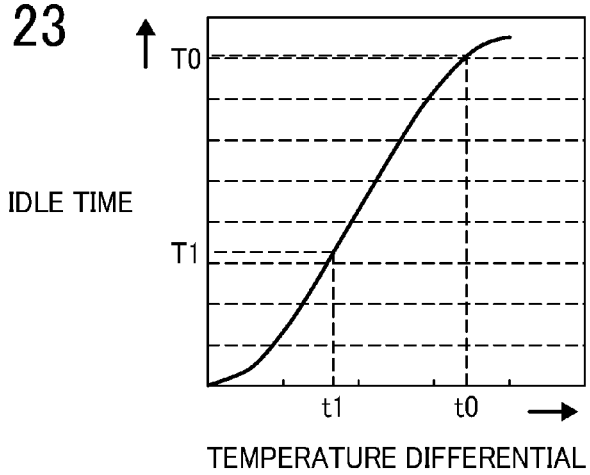
FIG. 23 is a graph showing the relation between the differential between the surface temperatures of the fixing roller detected by the temperature detectors shown in FIG. 21 and the time to idle the fixing roller.

Referring to FIG. 23, the following describes the method of determining the time to heat and at the same time idle the fixing roller 61.

FIG. 23 is a graph showing the relation between the differential between the surface temperature of the crown portion C1 detected by the first temperature detector 64A and the surface temperature of the inverted crown portion C2 detected by the second temperature detector 64B and the time to idle the fixing roller 61 required to eliminate variation in gloss of the toner image.

For example, as shown in FIG. 23, at the temperature differential t0 between the temperature of the crown portion C1 and the temperature of the inverted crown portion C2, the controller 15 heats and at the same time idles the fixing roller 61 for an idle time T0, during which heat is stored in the fixing roller 61 and at the same time in the pressing roller 62 and the pressing belt 65. Accordingly, when a recording medium P is conveyed to the fixing nip N at the idle time T0, it receives a sufficient amount of heat there, increasing the overall gloss of a toner image fixed on the recording medium P and thus rendering variation in gloss of the toner image visually unrecognizable.

Further, at the temperature differential t1 smaller than the temperature differential t0, the controller 15 idles the fixing roller 61 for the idle time T1 shorter than the idle time T0 corresponding to the temperature differential t0, rendering variation in gloss of the toner image visually unrecognizable.

The relation between the temperature differential between the surface temperature of the crown portion C1 and the surface temperature of the inverted crown portion C2 and the idle time of the fixing roller 61 varies depending on the type of toner and the elastic layer 61*b* of the fixing roller 61. For example, at the temperature differential t0 of 10 degrees centigrade, the idle time T0 is 15 seconds; at the temperature differential t1 of 5 degrees centigrade, the idle time T1 is 6 seconds.

Figure 24:
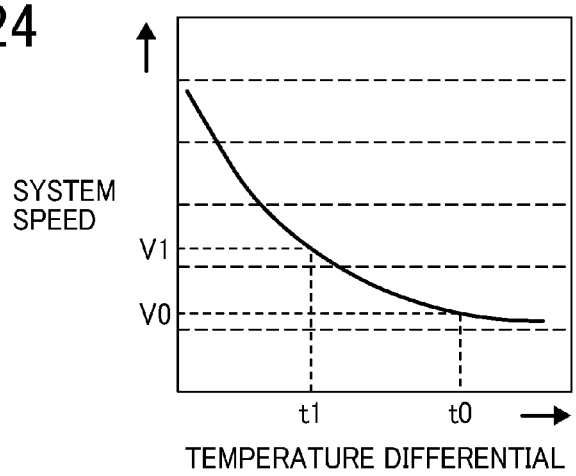
FIG. 24 is a graph showing the relation between the differential between the surface temperatures of the fixing roller detected by the temperature detectors shown in FIG. 21 and the system speed.

Referring to FIG. 24, the following describes the method of changing the system speed.

FIG. 24 is a graph showing the relation between the differential between the surface temperature of the crown portion C1 detected by the first temperature detector 64A and the surface temperature of the inverted crown portion C2 detected by the second temperature detector 64B and the system speed required to eliminate variation in gloss of the toner image.

The system speed defines a speed at which the recording medium P bearing the toner image is discharged from the fixing nip N. For example, in the image forming apparatus 1 depicted in FIG. 2 that outputs 20 pages per minute, the system speed is 12 mm/s.

As shown in FIG. 24, at the temperature differential t0, the system speed is set to a slower system speed V0. Accordingly, it takes longer time to convey the recording medium P from the paper tray 10 depicted in FIG. 2 to the fixing nip N, providing a time long enough to store heat in the fixing roller 61. Consequently, as the recording medium P passes through the fixing nip N, it receives a sufficient amount of heat, increasing the overall gloss of the toner image fixed on the recording medium P and thus rendering variation in gloss of the toner image visually unrecognizable. By contrast, at the temperature differential t1 smaller than the temperature differential t0, even at the system speed V1 higher than the system speed V0 corresponding to the temperature differential t0, variation in gloss of the toner image is visually unrecognizable.

As described above, the controller 15 controls one of the fixing temperature of the fixing roller 61, the idle time of the fixing roller 61, and the system speed based on the differential between the surface temperature of the crown portion C1 and the surface temperature of the inverted crown portion C2 of the fixing roller 61, eliminating variation in gloss of the toner image fixed on the recording medium P and thus resulting in formation of the high-quality toner image.

Referring to FIGS. 3, 6, 8, and 9, the following describes the advantages of the fixing devices 27 and 27S according to the above-described exemplary embodiments.

As illustrated in FIGS. 6 and 9, the crown portion (e.g., the crown portion C1) of the fixing rotary body (e.g., the fixing roller 61) presses against the inverted crown portion (e.g., the inverted crown portions D2 and E2) of the pressing member (e.g., the pressing roller 62 and the pressing pad 66) to form the waved fixing nip (e.g., the fixing nip N) therebetween. As a recording medium passes through the waved fixing nip N, it is waved along the waved fixing nip N, increasing the apparent rigidity of the recording medium which prevents the recording medium from being wound around the fixing rotary body as the recording medium is discharged from the fixing nip N.

Further, the crown portion pressing against the inverted crown portion minimizes variation in pressure between the fixing rotary body and the pressing member at the fixing nip, thus minimizing variation in gloss of a toner image fixed on the recording medium which results in formation of a high-quality toner image.

The crown portion and the inverted crown portion are produced by varying the thickness of the elastic layer (e.g., the elastic layers 61*b*, 62*b*, and 66*b*) of the fixing rotary body and the pressing member. Accordingly, even when the crown portion of the fixing rotary body is displaced from the corresponding inverted crown portion of the pressing member in the axial direction of the fixing rotary body, variation in pressure between the fixing rotary body and the pressing member at the fixing nip can be decreased, minimizing variation in gloss of the toner image fixed on the recording medium.

Further, the amount of heat stored in the fixing rotary body is adjusted based on the differential between the surface temperature of the crown portion (e.g., the crown portion C1) and the surface temperature of the inverted crown portion (e.g., the inverted crown portion C2) of the fixing rotary body. Accordingly, as the recording medium passes through the fixing nip, the sufficient amount of heat can be supplied to the recording medium at the fixing nip, enhancing the overall gloss of the toner image and thus rendering variation in gloss of the toner image visually unrecognizable.

The controller (e.g., the controller 15) changes the fixing temperature of the fixing rotary body based on the differential between the surface temperature of the crown portion and the surface temperature of the inverted crown portion of the fixing rotary body, retaining the amount of heat stored in the fixing rotary body required to eliminate variation in gloss of the toner image.

Alternatively, the controller heats and at the same time idles the fixing rotary body for the time period determined based on the differential between the surface temperature of the crown portion and the surface temperature of the inverted crown portion of the fixing rotary body, retaining the amount of heat stored in the fixing rotary body required to eliminate variation in gloss of the toner image.

Yet alternatively, the controller changes the system speed based on the differential between the surface temperature of the crown portion and the surface temperature of the inverted crown portion of the fixing rotary body, retaining the amount of heat stored in the fixing rotary body required to eliminate variation in gloss of the toner image.

When the fixing device or the image forming apparatus (e.g., the image forming apparatus 1 depicted in FIG. 2) is driven after it is stopped for a predetermined time due to malfunction such as jamming of the recording medium, the fixing rotary body does not have a uniform temperature distribution thereon. To address this problem, the fixing rotary body is heated and at the same time idled until it has a proper fixing temperature at which the high-quality toner image is formed on the recording medium.

At least one crown portion and at least one inverted crown portion are disposed over at least the entire conveyance region of the fixing rotary body and the pressing member through which the maximum recording medium passes, waving the recording medium passing through the conveyance region of the fixing rotary body and the pressing member. Accordingly, as the recording medium is discharged from the fixing nip formed between fixing rotary body and the pressing member, it is not wound around the fixing rotary body.

When the pressing member pressed against the fixing rotary body applies load to the fixing nip, and the wave height from the wave trough of the inverted crown portion to the wave crest of the crown portion at the fixing nip is smaller than about 0.16 mm, waves of the crown portion and the inverted crown portion are flattened or made gentle and therefore the recording medium passing over the flattened waves thereof is less waved, decreasing the apparent rigidity of the recording medium required to facilitate separation of the recording medium from the fixing rotary body. To address this problem, the wave height from the wave trough of the inverted crown portion to the wave crest of the crown portion at the fixing nip is set not smaller than about 0.16 mm to attain the sufficient apparent rigidity of the recording medium, preventing the recording medium from being would around the fixing rotary body.

Conversely, when the pressing member pressed against the fixing rotary body applies load to the fixing nip, and the wave height from the wave trough of the inverted crown portion to the wave crest of the crown portion at the fixing nip is greater than about 0.80 mm, the differential between the rotation speed of the crown portion and the rotation speed of the inverted crown portion increases, creasing the recording medium. To address this problem, the wave height from the wave trough of the inverted crown portion to the wave crest of the crown portion at the fixing nip is set not greater than about 0.80 mm to prevent the recording medium from creasing as it passes through the fixing nip, resulting in formation of the high-quality toner image on the recording medium.

As illustrated in FIG. 6, the identical end of the fixing rotary body and the pressing member, that is, the left lateral end of the fixing rotary body and the pressing member, is attached to the left side plate 71 immovably in the axial direction, that is, the longitudinal direction, of the fixing rotary body. Conversely, another end of the fixing rotary body and the pressing member, that is, the right lateral end of the fixing rotary body and the pressing member, is attached to the right side plate 72 movably in the axial direction and the longitudinal direction of the fixing rotary body. With this configuration, even when the fixing rotary body thermally expands in the axial direction thereof, both the fixing rotary body and the pressing member expand and move rightward, reducing displacement of the crown portion from the inverted crown portion of the fixing rotary body and the pressing member caused by the thermal expansion thereof. Consequently, variation in pressure between the fixing rotary body and the pressing member at the fixing nip can be minimized.

As described above, the fixing devices 27 and 27S according to the above-described exemplary embodiments are installed in the image forming apparatus 1 serving as a color printer. Alternatively, the fixing devices 27 and 27S may be installed in monochrome image forming apparatuses such as copiers, printers, facsimile machines, and multifunction printers having at least one of copying, printing, scanning, plotter, and facsimile functions, or the like.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

a fixing rotary body heated by a heater;

a pressing member pressed against the fixing rotary body to form a fixing nip therebetween through which the recording medium bearing the toner image passes, each of the fixing rotary body and the pressing member including a core and a waveform elastic layer provided on the core and having at least one wave crest and at least one wave trough to form a waveform face between the fixing rotary body and the pressing member where the wave trough of the pressing member is pressed against the wave crest of the fixing rotary body and the wave crest of the pressing member is pressed against the wave trough of the fixing rotary body;

a first temperature detector disposed on a surface thereof opposite the wave crest of the fixing rotary body to detect a first temperature thereof;

a second temperature detector disposed on a surface thereof opposite the wave trough of the fixing rotary body to detect a second temperature thereof; and a controller connected to the heater, the first temperature detector, and the second temperature detector to identify a temperature differential between the first temperature and the second temperature and adjust an amount of heat stored from the heater into the fixing rotary body based on the identified temperature differential.

2. The fixing device according to claim 1, wherein the pressing member includes a rotatable pressing roller.

3. The fixing device according to claim 1, further comprising a rotatable pressing belt, formed into a loop, contacting the fixing rotary body, wherein the pressing member includes a stationary pressing pad provided inside the loop formed by the pressing belt and pressed against the fixing rotary body via the pressing belt.

4. The fixing device according to claim 1, wherein the controller changes a fixing temperature of the fixing rotary body at which the fixing rotary body fixes the toner image on the recording medium based on the temperature differential between the first temperature and the second temperature.

5. The fixing device according to claim 1, further comprising a driver connected to the controller and the fixing rotary body to rotate the fixing rotary body, wherein the controller determines a time to heat and at the same time idle the fixing rotary body by the heater and the driver based on the temperature differential between the first temperature and the second temperature.

6. The fixing device according to claim 1, further comprising a driver connected to the controller and the fixing rotary body to rotate the fixing rotary body, wherein the controller changes a rotation speed of the fixing rotary body rotated by the driver at which the fixing rotary body conveys the recording medium at the fixing nip based on the temperature differential between the first temperature and the second temperature.

7. The fixing device according to claim 6, wherein, when the fixing device is driven after being stopped for a set time, the controller heats and at the same time idles the fixing rotary body for a set time.

8. The fixing device according to claim 1, wherein the at least one wave crest and the at least one wave trough of each of the fixing rotary body and the pressing member extend over a region of the fixing rotary body and the pressing member through which a recording medium of a maximum width that can be accommodated by the fixing device passes.

9. The fixing device according to claim 1, wherein, during operation, in a state in which the pressing member is pressed against the fixing rotary body, a wave height from the wave trough to the wave crest of the waveform face formed at the fixing nip is in a range of from 0.16 mm to 0.80 mm.

10. The fixing device according to claim 1, further comprising:

a first support to movably support one lateral end of each of the fixing rotary body and the pressing member in an axial direction of the fixing rotary body; and a second support to immovably support another lateral end of each of the fixing rotary body and the pressing member in the axial direction of the fixing rotary body.

11. An image forming apparatus comprising the fixing device according to claim 1.

12. The fixing device according to claim 1, wherein the elastic layer of the fixing rotary body has a varied thickness in an axial direction of the fixing rotary body, with portions of increased thickness alternating with portions of decreased thickness.

13. The fixing device according to claim 12, wherein the elastic layer of the fixing rotary body includes a crown portion that is convex and an inverted crown portion that is concave, alternately provided in the axial direction of the fixing rotary body on an outer circumferential surface thereof.

14. The fixing device according to claim 1, wherein the elastic layer of the pressing member has a varied thickness in an axial direction of the pressing member, with portions of increased thickness alternating with portions of decreased thickness.

15. The fixing device according to claim 13, wherein the elastic layer of the pressing member includes a crown portion that is convex and an inverted crown portion that is concave, alternately provided in the axial direction of the pressing member on an outer circumferential surface thereof.

16. The fixing device according to claim 1, wherein a number of wave crest and wave trough of the fixing rotary body is equal to a number of wave crest and wave trough of the pressing member.

* * * * *